US011852986B2

(12) United States Patent
Hirose et al.

(10) Patent No.: US 11,852,986 B2
(45) Date of Patent: Dec. 26, 2023

(54) IMAGE FORMING APPARATUS

(71) Applicant: CANON KABUSHIKI KAISHA, Tokyo (JP)

(72) Inventors: Masaki Hirose, Kanagawa (JP); Taisuke Minagawa, Shizuoka (JP); Yusaku Iwasawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/946,866

(22) Filed: Sep. 16, 2022

(65) Prior Publication Data

US 2023/0099533 A1 Mar. 30, 2023

(30) Foreign Application Priority Data

Sep. 17, 2021 (JP) ..... 2021-152692

(51) Int. Cl.
*G03G 15/02* (2006.01)

(52) U.S. Cl.
CPC ..... *G03G 15/0266* (2013.01)

(58) Field of Classification Search
CPC .. G03G 15/0266; G03G 15/065; G03G 15/50; G03G 15/5029; G03G 15/1675
See application file for complete search history.

(56) References Cited

U.S. PATENT DOCUMENTS

2004/0190921 A1* 9/2004 Bae ..... G03G 15/0266 399/50
2005/0074249 A1* 4/2005 Nishimura ..... G03G 15/1675 399/66

FOREIGN PATENT DOCUMENTS

JP 06-83249 A 3/1994
JP 2000-293019 A 10/2000
JP 2003-262993 A 9/2003
JP 2006-084877 A 3/2006

* cited by examiner

*Primary Examiner* — Sandra Brase
(74) *Attorney, Agent, or Firm* — Venable LLP

(57) ABSTRACT

An image forming apparatus includes a photosensitive member, a charging member, a charging power source, a developing member, a transfer member, a transfer power source, an acquiring portion, and a controller. The controller controls a charging voltage to be a first charging voltage when an electric resistance value of the transfer member is a first resistance value and to be a second charging voltage not less than the first charging voltage in absolute value when the electric resistance value is a second resistance value lower than the first resistance value, and so that a change amount of the charging voltage when the electric resistance value is changed from the second resistance value to a third resistance value lower than the second resistance value is greater than a change amount of the charging voltage when the electric resistance value is changed from the first resistance value to the second resistance value.

16 Claims, 7 Drawing Sheets

IMAGE FORMING APPARATUS

FIELD OF THE INVENTION AND RELATED ART

The present invention relates to an image forming apparatus, such as a printer, a copying machine, or a facsimile machine, of an electrophotographic type.

Conventionally, in the image forming apparatus of the electrophotographic type, a surface of an electrophotographic photosensitive member is electrically charged substantially uniformly by a charging means, so that a dark-portion potential is formed on the surface of the photosensitive member. Thereafter, the charged surface of the photosensitive member is exposed to light by an exposure means, so that a light-portion potential is formed on the surface of the photosensitive member, and an electrostatic latent image is formed on the photosensitive member by a contrast between the dark-portion potential and the light-portion potential. Then, toner is deposited on the electrostatic latent image, formed on the photosensitive member, by a developing means, so that a toner image is formed on the photosensitive member.

Then, the toner image formed on the photosensitive member is transferred onto a recording material by a transfer means. As the transfer means, a transfer roller which is a roller-like transfer member is used in many cases. The transfer roller is contacted to the photosensitive member and forms a transfer nip, and is rotated in a contact state with the photosensitive member. The transfer roller not only nips and feeds the recording material between itself and the photosensitive member, but also transfers the toner image from the photosensitive member onto the recording material. During the transfer, to the transfer roller, a transfer voltage of an opposite polarity to a normal charge polarity of the toner is applied, so that the toner image on the photosensitive member is electrostatically transferred onto the recording material. Incidentally, in the following, the recording material is called "paper (sheet")", but the recording material is not limited to the paper. Further, for convenience, high/low and increase/decrease of the potential and the voltage refer to those in the case where absolute values the potentials or the voltages are compared with each other.

In the transfer nip, with respect to a direction substantially perpendicular to a movement direction of the surface of the photosensitive member (recording material feeding direction), a region where the recording material passes and a region where the recording material does not pass are formed. Here, in the transfer nip, the region where the recording material passes is called a "sheet-passing region", and the region where the recording material does not pass is called a "non-sheet-passing region". Further, for convenience, also, regions of the photosensitive member corresponding to the "sheet-passing region" and the "non-sheet-passing region" of the transfer nip are called a "sheet-passing region" and a "non-sheet-passing region", respectively. The non-sheet-passing region is formed, in general, outside the sheet-passing region adjacently to each of ends of the sheet-passing region with respect to the direction substantially perpendicular to the movement direction of the surface of the photosensitive member. The recording material acts as an electric resistor when the toner image is transferred from the photosensitive member onto the recording material, and therefore, a transfer current easily flows through the non-sheet-passing region concentratedly. For that reason, after the transfer, a surface potential of the photosensitive member in the non-sheet-passing region becomes lower than a surface potential of the photosensitive member (non-exposure portion) in the sheet-passing region.

Such a potential difference between the surface potential of the photosensitive member in the non-sheet-passing region and the surface potential of the sheet-passing region after the transfer is eliminated during subsequent charging of the surface of the photosensitive member. However, in the case where the above-described potential difference is large, even after the charging, the potential difference between the surface potential of the photosensitive member in the non-sheet-passing region and the surface potential of the photosensitive member in the sheet-passing region remains in some instances. For that reason, during development, between the non-sheet-passing region and the sheet-passing region, there also arises a difference in potential relationship between the photosensitive member and a developing device in some instances. Particularly, in the non-sheet-passing region, a potential difference between the non-exposed portion of the photosensitive member and the developing device becomes small, so that a phenomenon which is called "fog" such that the toner is deposited on the surface of the photosensitive member occurs in some instances. Further, the toner deposited on the surface of the photosensitive member in the non-sheet-passing region by the "fog" causes "end portion contamination" in some instances such that the toner is deposited on the recording material at an end portion with respect to a direction (widthwise direction) substantially perpendicular to the recording material feeding direction in the case where the recording material is obliquely fed during the transfer or in the like case.

In Japanese Laid-Open Patent Application No. Hei 6-83249, a constitution in which a pre-exposure means for exposing the photosensitive member surface to light is provided on a side downstream of the transfer nip and upstream of a charging position by a charging means with respect to a rotational direction of the photosensitive member is disclosed. By providing the pre-exposure means, the potential difference, generated in the transfer nip, between the surface potential of the photosensitive member in the non-sheet-passing region and the surface potential of the photosensitive member in the sheet-passing region is eliminated, so that the "end portion contamination" can be suppressed.

However, for example, in the case where the potential difference, generated in the transfer nip, between the photosensitive member surface potential in the non-sheet-passing region and the photosensitive member surface potential in the sheet-passing region is eliminated by discharging the photosensitive member surface with use of the pre-exposure means as described above, and discharge amount of the photosensitive member during the charging increases. When the discharge amount of the photosensitive member increases, image defect called "image flow" is liable to occur. The "image flow" is the image defect such that an electric discharge product generated during the discharge is deposited on the photosensitive member and absorbs moisture, so that normal charging of the photosensitive member cannot be performed and thus an image density lowers. In recent years, lifetime extension of the image forming apparatus is advanced, and there is a tendency to increase the discharge amount of the photosensitive member due to use of the image forming apparatus for a long term, and this tendency forms a cause such that the image flow is liable to occur.

Thus, from the viewpoint of the discharge amount, the "end portion contamination" and "image flow" are in a relationship of trade-off.

SUMMARY OF THE INVENTION

A principal object of the present invention is to provide an image forming apparatus capable of suppressing end portion contamination while suppressing image flow.

This object is achieved by an image forming apparatus according to the present invention.

An aspect of the present invention is to provide an image forming apparatus for forming an image on a recording material, comprising a rotatable photosensitive member; a charging member configured to electrically charge a surface of the photosensitive member; a charging power source configured to apply a charging voltage to the charging member; a developing member configured to form a toner image by supplying toner to a surface of the photosensitive member charged by the charging member; a transfer member forming a transfer portion in contact with the surface of the photosensitive member and configured to transfer the toner image from the surface of the photosensitive member onto the recording material passing through the transfer portion; a transfer power source configured to apply a transfer voltage to the transfer member; an acquiring portion configured to acquire information on an electric resistance value of the transfer member; and a controller capable of controlling the charging power source, wherein the controller controls the charging voltage, applied in an image forming operation for forming the toner image on the recording material, depending on the electric resistance value of the transfer member indicated by the information acquired by the acquiring portion, wherein the controller controls the charging voltage so that the charging voltage is a first charging voltage in a case that the electric resistance value of the transfer member indicated by the information acquired by the acquiring portion is a first resistance value and so that the charging voltage is a second charging voltage having an absolute value not less than an absolute value of the first charging voltage in a case that the electric resistance value is a second resistance value lower than the first resistance value, and wherein in a case that images are continuously formed on recording materials, the controller controls the charging voltage so that a change amount of the charging voltage in a case that the electric resistance value of the transfer member is changed from the second resistance value to a third resistance value lower than the second resistance value is greater than a change amount of the charging voltage in a case that the electric resistance value is changed from the first resistance value to the second resistance value.

Another object of the present invention is to provide an image forming apparatus for forming an image on a recording material, comprising a rotatable photosensitive member; a charging member configured to electrically charge a surface of the photosensitive member; a developing member configured to form a toner image by supplying toner to a surface of the photosensitive member charged by the charging member; a developing power source configured to apply a developing voltage to the developing member during formation of the toner image; a transfer member forming a transfer portion in contact with the surface of the photosensitive member and configured to transfer the toner image from the surface of the photosensitive member onto the recording material passing through the transfer portion; a transfer power source configured to apply a transfer voltage to the transfer member; an acquiring portion configured to acquire information on an electric resistance value of the transfer member; and a controller capable of controlling the developing power source, wherein the controller controls the developing voltage, applied in an image forming operation for forming the toner image on the recording material, depending on the electric resistance value of the transfer member indicated by the information acquired by the acquiring portion, wherein the controller controls the developing voltage so that the developing voltage is a first developing voltage in a case that the electric resistance value of the transfer member indicated by the information acquired by the acquiring portion is a first resistance value and so that the developing voltage is a second developing voltage having an absolute value not more than an absolute value of the first developing voltage in a case that the electric resistance value is a second resistance value lower than the first resistance value, and wherein in a case that images are continuously formed on recording materials, the controller controls the developing voltage so that a change amount of the developing voltage in a case that the electric resistance value of the transfer member is changed from the second resistance value to a third resistance value lower than the second resistance value is greater than a change amount of the developing voltage in a case that the electric resistance value is changed from the first resistance value to the second resistance value.

Further features of the present invention will become apparent from the following description of exemplary embodiments with reference to the attached drawings.

DESCRIPTION OF THE EMBODIMENTS

In the following, an image forming apparatus according to the present invention will be described specifically with reference to the drawings.

(1) Image Forming Apparatus

Figure 1:
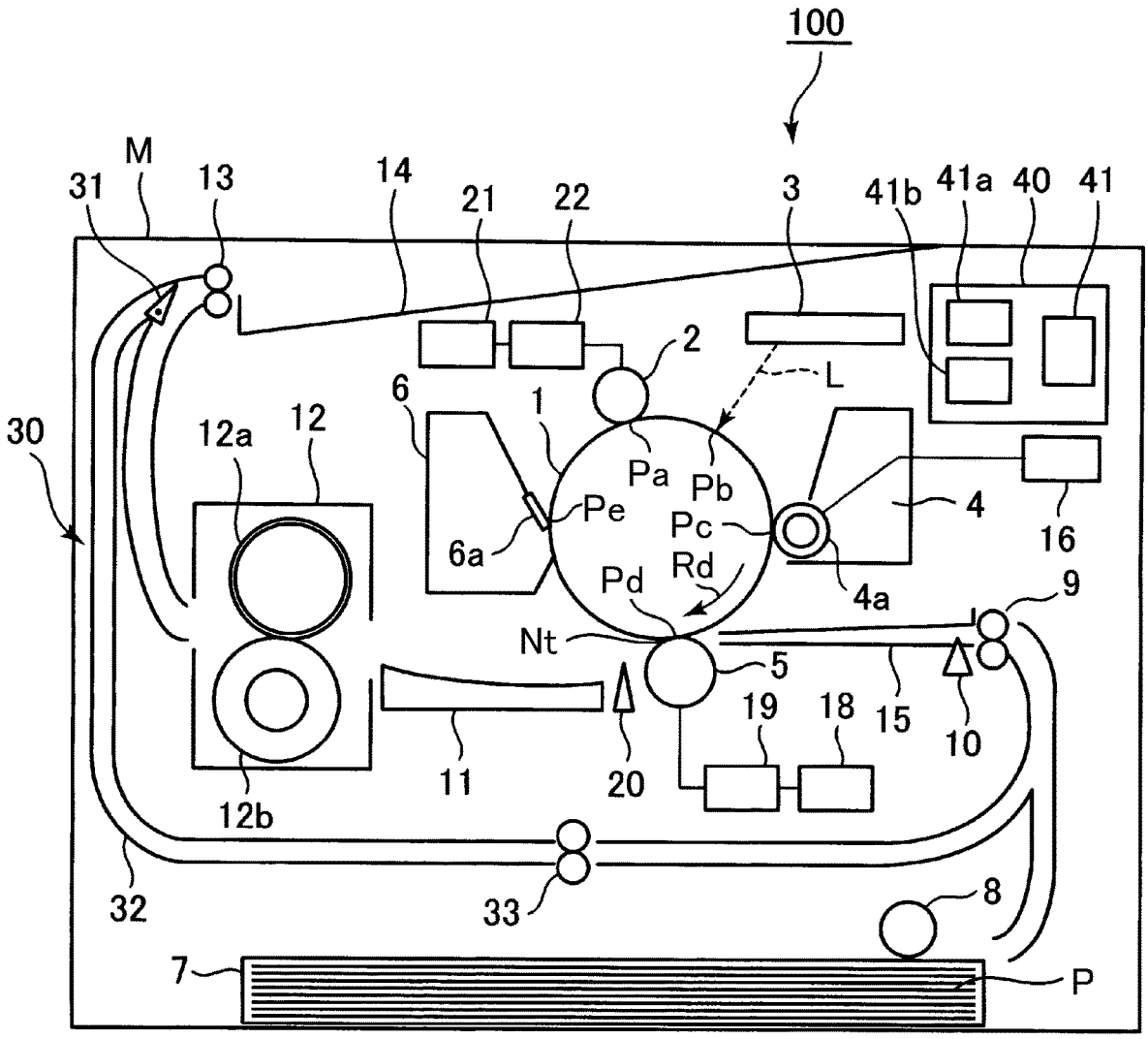
FIG. 1 is a schematic sectional view of an image forming apparatus.

FIG. 1 is a schematic sectional view of an image forming apparatus 100 of this embodiment. The image forming apparatus 100 of this embodiment is a laser beam printer of an electrophotographic type and is capable of forming an image on a recording material P, such as paper or a plastic film, depending on image information inputted from an external device (not shown) such as a personal computer. First, a constitution of the image forming apparatus 100 of this embodiment will be described.

The image forming apparatus 1 includes a photosensitive drum 1 which is drum-shaped (cylindrical) photosensitive member as an image bearing member inside an apparatus main assembly M. The photosensitive drum 1 is constituted by providing a photosensitive material, such as OPC (organic photoconductor, organic photo-semiconductor), amorphous selenium, or amorphous silicon on a cylindrical drum substrate formed of aluminum, nickel, or the like. The photosensitive drum 1 used in this embodiment is a negatively chargeable OPC photosensitive member of φ24 mm in outer diameter. This photosensitive drum 1 is constituted by including on a surface of an electroconductive substrate constituted by an aluminum cylinder, a photosensitive layer obtained by laminating a charge-generating layer and a charge-transporting layer in a named order on the electroconductive substrate.

Around the photosensitive drum 1, along a rotational direction Rd thereof, the following means are provided in a named order. First, a charging roller 2 which is a roller-shaped charging member as a charging means is provided.

The charging roller 2 is constituted by, for example, an electroconductive base shaft (core metal) also functioning as an energization electrode, and an elastic layer cylindrically surrounding an outer peripheral surface of the core metal. The charging roller 2 used in this embodiment is an elastic roller of φ10 mm in roller outer diameter φ5 mm in core metal diameter, and 2.5 mm in thickness of the elastic layer. In this embodiment, SUS is used in the core metal, as a mixture rubber material of NBR and epichlorohydrin rubber is used in the elastic layer. The charging roller 2 is press-contacted to the photosensitive drum 1 and is rotated with rotation of the photosensitive drum 1.

With respect to a rotational direction of the photosensitive drum 1, a position on the photosensitive drum 1 where the photosensitive drum surface is charged by the charging roller 2 is a charging position Pa. The charging roller 2 charges the surface of the photosensitive drum 1 by electric discharge generating in at least one of minute gaps, between the photosensitive drum 1 and the charging roller 2, formed on sides upstream and downstream of a contact portion between the photosensitive drum 1 and the charging roller 2 with respect to the rotational direction of the photosensitive drum 1. However, for simplicity, it would be considered that the contact portion between the photosensitive drum 1 and the charging roller 2 is regarded as the charging position Pa.

Next, an exposure device 3 as an exposure means is provided. In this embodiment, the exposure device 3 is constituted by a laser scanner device (laser optical system). With respect to the rotational direction of the photosensitive drum 1, a position where the surface of the photosensitive drum 1 is exposed to light by the exposure device 3 is an exposure position Pb.

Next, a developing device 4 as a developing means is provided. In this embodiment, in the developing device 4, a non-magnetic one-component developer (toner) is used as a developer. This developing device 4 includes a developing roller 4*a* as a developer carrying member (developing member). The developing roller 4*a* is contacted to the surface of the photosensitive drum 1 developing voltage development and supplies the toner to a developing portion which is an opposing portion (contact portion) to the photosensitive drum 1. Incidentally, as the developer, the developing device 4 may use a magnetic one-component developer (toner) or a two-component developer containing toner and a carrier. With respect to the rotational direction of the photosensitive drum 1, a position on the photosensitive drum 1 where the toner is supplied by the developing roller 4*a* (a position of contact of the photosensitive drum 1 with the developing roller 4*a* in this embodiment) is a developing position Pc.

Next, a transfer roller 5 which is a roller-shaped transfer member (rotatable transfer member) as a transfer means is provided. The transfer roller 5 is urged (pressed) toward the photosensitive drum 1 by a transfer pressing spring (not shown) which is an urging member as an urging means, and is press-contacted to the photosensitive drum 1. By this, a transfer nip (transfer nip portion) Nt which is a contact portion between the photosensitive drum 1 and the transfer roller 5 is formed. The transfer roller 5 is rotated with rotation of the photosensitive drum 1. The transfer roller 5 not only nips and feeds the recording material P between itself and the photosensitive drum 1, but also transfers the toner image from the photosensitive drum 1 onto the recording material P under application of a voltage. The transfer roller 5 is constituted, for example, by an electroconductive base shaft (core metal) also functioning as an energization electrode, and an elastic layer cylindrically surrounding an outer peripheral surface thereof. As a material of this elastic layer, in general, a semiconductor rubber material constituted by using EPDM, NBR, urethane rubber, epichlorohydrin rubber, silicone rubber, or the like is used. The material of the elastic layer may contain an electroconductive agent, such as an ion-conductive agent, in an appropriate amount. The transfer roller 5 used in this embodiment is an elastic roller of 14 mm in roller outer diameter, φ5 mm in core metal diameter, and 4.5 mm in thickness of the elastic layer. In this embodiment, SUS is used in the core metal, and a mixture rubber material of NBR and epichlorohydrin rubber is used in the elastic layer. Further, in this embodiment, a contact pressure of the transfer roller 5 to the photosensitive drum 1 is 9.8 N (1 kgf). Further, in this embodiment, an electric resistance value of the transfer roller 5 is $2.0\times10^{8}\Omega$ in a state in which the transfer roller 5 is pressed against an aluminum cylinder by a force of 9.8 N and is rotated at a speed of 50 mm/sec under application of a voltage of +1000 V. Incidentally, the resistance value of this transfer roller 5 is measured in the case where the transfer roller 5 is left standing under a normal temperature/normal humidity environment. With respect to the rotational direction of the photosensitive drum 1, a position where the toner image on the photosensitive drum 1 is transferred onto the recording material P (position corresponding to the above-described transfer nip Nt) is a transfer position Pd.

Next, a charge-removing needle 20 as a charge-removing member for not only removing excessive electric charges on the surface of the recording material P after the transfer but also reducing a degree of potential non-uniformity on the photosensitive drum 1 generated by peeling (electric) discharge is provided. As the charge-removing needle 20, it is possible to use a charge-removing needle which is provided with a saw-tooth-like sharp end portion and which is formed with a thin metal plate material, such as SUS plate or aluminum plate, having good electroconductivity. This charge-removing needle 20 is disposed on a side downstream of the transfer roller 5 with respect to the feeding direction of the recording material P so that a needle tip opposes the surface of the photosensitive drum 1.

Next, a cleaning device 6 as a cleaning means of a deposited matter such as toner (transfer residual toner) remaining on the photosensitive drum 1 after the transfer is provided. In this embodiment, the cleaning device 6 includes a cleaning blade 6*a* as a cleaning member provided so as to contact the surface of the photosensitive drum 1. With respect to the rotational direction, a position where the toner on the photosensitive drum 1 is removed by the cleaning blade 6*a* (position where the photosensitive drum 1 contacts the cleaning blade 6*a*) is a cleaning position Pe.

Further, at a lower portion of the apparatus main assembly in FIG. 1, a recording material cassette 7 in which the recording material (transfer material, recording medium, sheet) P such as paper is accommodated is provided. Further, along a feeding passage of the recording material P from the recording material cassette 7, a feeding roller 8, a conveying roller 9, a top sensor 10, a pre-transfer conveying guide 15, a transfer-fixing conveying guide 11, a fixing device 2, a discharging roller 13 and a discharge tray 14 is disposed in a named order. Further, the apparatus main assembly M is provided with a controller 40 for carrying out control of the image forming apparatus 100.

Next, an image forming operation in the image forming apparatus 100 of this embodiment will be described. The photosensitive drum 1 is rotationally driven in an arrow Rd direction (clockwise direction) in FIG. 1 at a peripheral speed (process speed) of 320 mm/sec by a driving source (not shown). The surface of the rotating photosensitive drum 1 is electrically charged by the charging roller 2 substantially uniformly to a predetermined potential (dark-portion potential, charge potential) of the same polarity as a normal charge polarity (negative in this embodiment) of the toner. During the charging, to the charging roller 2, a charging voltage (charging bias) which is a DC voltage of the negative polarity is applied from a charging power source (high-voltage power source) 21 through a charging current detecting circuit 22. In this embodiment, as an example, a charging voltage of −1100 V is applied to the charging roller 2, so that a dark-portion potential of −500 V is formed on the surface of the photosensitive drum 1.

The charged surface of the photosensitive drum 1 is exposed to image light L depending on image information by the exposure device 3, so that an electrostatic latent image (electrostatic image) is formed on the photosensitive drum 1. In this embodiment, electric charges on the photosensitive drum 1 at a portion exposed to the light by the exposure device 3 are removed, so that a light-portion potential of −100 V is formed on the surface of the photosensitive drum 1. By this, the electrostatic latent image is formed on the photosensitive drum 1 by a contrast between the above-described dark-portion potential and the above-described light-portion potential.

The electrostatic latent image formed on the photosensitive drum 1 is developed (visualized by being supplied with the toner by the developing device 4, so that the toner image (developer image) is formed on the photosensitive drum 1. During the development, to the developing roller 4*a*, a developing voltage (developing bias) which is a DC voltage of the same polarity (negative in this embodiment) as the normal charge polarity of the toner is applied from a developing power source (high-voltage power source) 16. In this embodiment, as an example, the developing voltage of −380 V is applied to the developing roller 4*a*. In this embodiment, on an exposure portion (image portion) of the photosensitive drum 1 where an absolute value of the surface potential lowered by the exposure after the photosensitive drum surface is charged substantially uniformly, toner charged to the same polarity (negative in this embodiment) as the charge polarity of the photosensitive drum 1 is deposited (reverse development type).

The toner image formed on the photosensitive drum 1 is transferred onto the recording material P in the transfer nip Nt by the action of the transfer roller 5. During the transfer, to the transfer roller 5, a transfer voltage (transfer bias) which is a DC voltage of an opposite polarity (positive in this embodiment) to the normal charge polarity of the toner is applied from a transfer power source (high-voltage power source) 18 through a transfer current detecting circuit 19 as a transfer current detecting means. By this, the toner image on the photosensitive drum 1 is electrostatically transferred to a predetermined position of the recording material P. The recording material P is accommodated in the recording material cassette 7 as a recording material accommodating portion and is fed one by one by the feeding roller 8 as a feeding member. This recording material P is conveyed by the conveying roller 9 as a conveying member, and is supplied to the transfer nip Nt along the pre-transfer conveying guide 15 as a guiding member. On the basis of a detection result of the leading end of the recording material P with respect to the feeding direction by the top sensor 10 as the recording material detecting means, the feeding roller 9 supplies the recording material P to the transfer nip Nt so as to be timed to the toner image on the photosensitive drum 1.

From the recording material P on which the toner image is transferred in the transfer nip Nt, surface electric charges in an excessive charge amount are removed by the charge removing needle 20. The recording material P passed through the charge removing needle 20 is conveyed toward the fixing device 12 as a fixing means along the transfer-fixing conveying guide 11 as a guiding member. The fixing device 12 includes a fixing roller 12*a* and a pressing roller 12*b* press-contacting the fixing roller 12*a*. The fixing device 12 heats and presses the recording material P, on which an unfixed toner image is carried, passing through a (fixing) nip between these rollers, so that the toner image is fixed on the recording material P.

In the case of one-side image formation, the recording material P after the toner image is fixed on one side (surface) of the recording material P by the fixing device 12 is discharged (outputted) by the discharging roller 13 on the discharge tray 14 formed at an upper surface of the apparatus main assembly M in FIG. 1. Further, in this embodiment, the image forming apparatus 100 is capable of double-side image formation (automatic double-side printing), and is provided with a double-side feeding (conveying) mechanism 30. The double-side feeding mechanism 30 is constituted by including a flapper 31 as a feeding passage switching means, a double-side feeding passage 32, a double-side feeding roller 33 as a feeding member, and the like. During the double-side image formation, before a trailing end, with respect to the recording material feeding direction, of the recording material P on which first side (surface) the toner image is fixed passes through the discharging roller 13, not only rotation of the discharging roller 13 is reversed, but also a position of the flapper 31 is changed, so that the recording material P is guided to the double-side feeding passage 31. This recording material P is conveyed to the conveying roller 9 by the double-side feeding roller 33 and the like. Then, onto a second side (surface) of this recording material P, the toner image is transferred and fixed similarly as in the case of the first side. Thereafter, the recording material P on which double sides (surfaces) the toner images are fixed is discharged on the discharge tray 14 by the discharging roller 13.

On the other hand, a deposited matter such as toner (transfer residual toner) remaining on the surface of the photosensitive drum 1 without being transferred during the transfer is removed and collected from the surface of the photosensitive drum 1 by the cleaning device 6. The cleaning device 6 scrapes off the deposited matter such as the transfer residual toner from the surface of the rotating photosensitive drum 1 by the cleaning blade 6*a*, and accommodates the deposited matter in a container thereof.

By repeating the above-described operation, image formation can be successively carried out. In this embodiment, the image forming apparatus 100 is capable of executing printing at a print speed of 60 sheets per min.

Incidentally, in this embodiment, the photosensitive drum 1 and, as the process means actable on the photosensitive drum 1, the charging roller 2, the developing device 4, and the cleaning device 6 integrally constitute a process cartridge detachably mountable to the apparatus main assembly M of the image forming apparatus 100. The controller 40 is constituted by including a CPU 41 as a calculation (computation) control means, a ROM 41*a* and a RAM 41*b* as a storing means, an input/output portion (not shown) for controlling transfer of signals between the controller 40 and the respective portions other than the controller 40, and the like. The CPU 41 executes various programs stored in the ROM 41*a*, whereby the CPU 41 controls various operations relating to the image formation while using the RAM 41*b* as a working area. Incidentally, in the ROM 41*a*, a data table for preset various control values (operation settings), pieces of information of preset various thresholds, which are used in control of an image forming condition (described later), and the like are stored.

Here, the image forming apparatus 1 executes a print job (print, printing operation, printing job) which is a series of operations for forming and outputting the image (images) on a single or a plurality of recording materials P and which is started by a single starting instruction. The print job includes in general an image forming step, a pre-rotation step, a sheet interval step in the case where the images are formed on the plurality of recording materials P, and a post-rotation step. The image forming step is a period in which formation of the electrostatic latent image for the image formed and outputted on the recording material P, formation of the toner image, and transfer of the toner image, and the like are carried out in actuality, and during image formation refers to this period. Specifically, a timing during image formation is different at each of the positions where the respective steps of the formation of the electrostatic latent image, the formation of the toner image, the transfer of the toner image, and the like are carried out, and corresponds to a period in which an image forming region on the photosensitive drum 1 passes through an associated one of the above-described respective positions. The pre-rotation step is period from the input of the start instruction until the image is started to be formed in actuality, in which a preparation operation before the image forming step is performed. The sheet interval step (image interval step, recording material interval step) is a period corresponding to an interval between two recording materials P when the images are continuously formed on the plurality of recording materials P (continuous image formation). The post-rotation step is period in which a post operation (preparatory operation) after the image forming step is performed. During non-image formation is a period other than during the image formation and includes the periods of the pre-rotation step, the sheet interval step, the post-rotation step, and in addition, during turning-on of a power source of the image forming apparatus 100, a pre-multi-rotation step which is a preparatory operation step during restoration from a sleep state, or the like. Specifically, a timing during the non-image formation corresponds to a period in which a non-image forming region on the photosensitive drum 1 passes through the associated one of the respective positions where the steps of forming the electrostatic latent image, forming the toner image, and transferring the toner image are performed. Incidentally, the image forming region on the photosensitive drum 1 or the recording material P refers to a region which is defined in advance depending on a size of the recording material P and on which the toner image transferred onto the recording material P and then outputted from the image forming apparatus 100 is capable of being outputted, and the non-image forming region refers to a region other than the image forming region. Incidentally, in this embodiment, in a predetermined region of each of a leading end portion and a trailing end portion of the recording material P with respect to the recording material feeding direction, a margin portion which is the non-image forming region, is provided.

(2) Positional Relationship with Respect to the Longitudinal Direction

Figure 2:
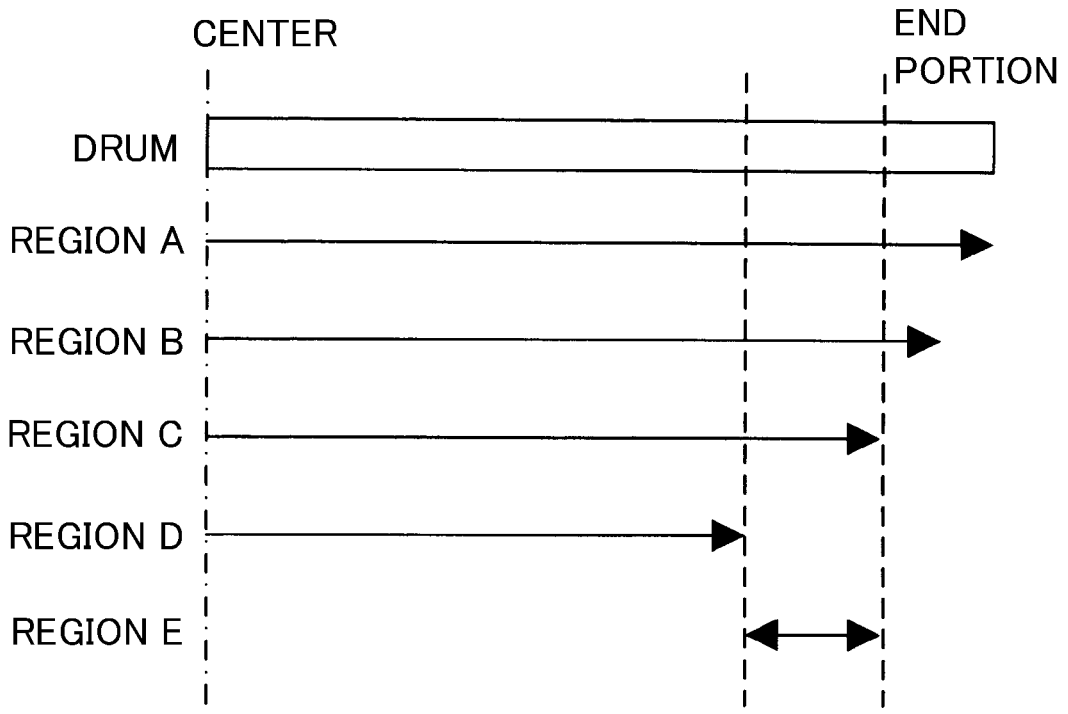
FIG. 2 is a schematic view showing a positional relationship of portions around a photosensitive drum with respect to a longitudinal direction.

FIG. 2 is a schematic view for illustrating a positional relationship between respective portions around the photosensitive drum 1 with respect to a direction substantially perpendicular to the movement direction of the surface of the photosensitive drum 1 (feeding direction of the recording material P). This positional relationship changes depending on the size (particularly, a width with respect to the direction substantially perpendicular to the recording material feeding direction) of the recording material P used in the image formation, but in FIG. 2, the positional relationship in the case where the size of the recording material P is an A4 size is shown. Incidentally, the direction substantially perpendicular to the surface movement direction of the photosensitive drum 1 (recording material feeding direction) (i.e., a direction substantially parallel to a rotational axis direction of the photosensitive drum 1) is referred to as a "longitudinal direction" in some instances.

In FIG. 2, a "photosensitive member region A" shows a region in which a photosensitive layer of the photosensitive drum 1 is formed with respect to the longitudinal direction or a width of the region. Further, in FIG. 2, a "charging region B" shows a region in which the charging roller 2 is contactable to the surface of the photosensitive drum 1 with respect to the longitudinal direction or a width of the region. Further, in FIG. 2, "transfer region C" shows a region in which the transfer roller 5 is contactable to the surface of the photosensitive drum 1 with respect to the longitudinal direction or a width of the region. Further, in FIG. 2, a "sheet-passing region D" is a region in which in the transfer nip Nt, the recording material P passes or a width of the region. Further, in FIG. 2, a "non-sheet-passing region E" is a region in which in the transfer nip Nt, the recording material P does not pass or a width of the region (i.e., a region of a difference between the transfer region C and the sheet-passing region D or a width of this region). Incidentally, for convenience, regions on the photosensitive drum 1 corresponding to the "charging region B", the "transfer region C", the "sheet-passing region D", and the "non-sheet-passing region E" are also referred to as the "charging region B", the "transfer region C", the "sheet-passing region D", and the "non-sheet-passing region E", respectively.

In this embodiment, each of the "photosensitive member region A", the "charging region B", the "transfer region C" and the "sheet-passing region D" is disposed so that a center of the associated region coincides with a center of the image forming region (region in which the toner image is capable of being formed) substantially with respect to the longitudinal direction (center basis). Further, of the above-described regions, a region relatively narrower in width with respect to the longitudinal direction is included inside a region relatively broader in width with respect to the longitudinal direction. Incidentally, in FIG. 2, a range from the center to one end portion side with respect to the longitudinal direction is illustrated.

(3) Surface Potential Difference of Photosensitive Drum with Respect to Longitudinal Direction Next, using FIG. 3, progression of the surface potential of the photosensitive drum 1 during the image formation will be described.

Figure 3:
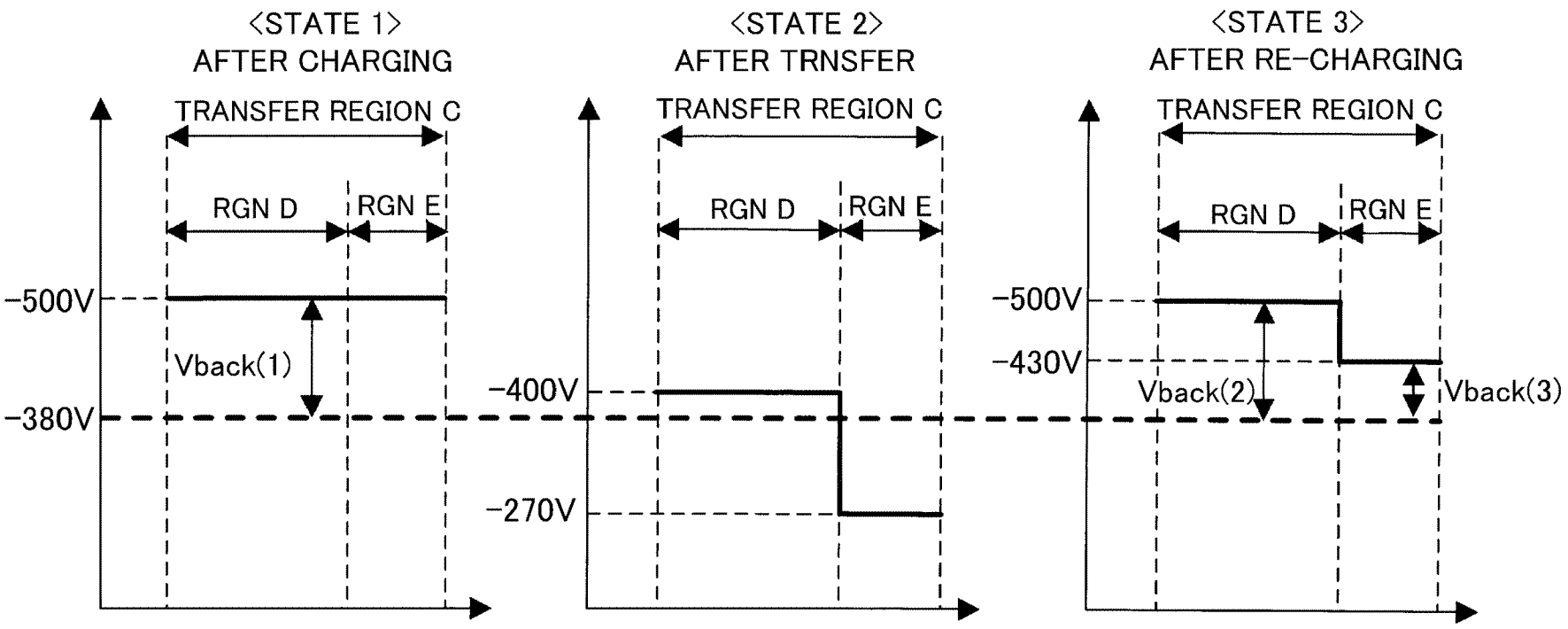
FIG. 3 is a graph for illustrating progression of a surface potential of the photosensitive drum.

In FIG. 3, the abscissa represents a position on the photosensitive drum 1 with respect to the longitudinal direction and illustrates each of the above-described transfer region C, the above-described sheet-passing region D, and the above-described non-sheet-passing region E. Further, in FIG. 3, the ordinate represents the surface potential of the photosensitive drum 1 and shows that the surface potential of the photosensitive drum 1 is higher in a negative (−) side (i.e., an absolute value of the surface potential of the negative polarity is larger) with an upper portion in FIG. 3. Further, the surface potential of the photosensitive drum 1 in the sheet-passing region D is a surface potential of the non-exposure portion on the photosensitive drum 1. Further, the surface potential of the photosensitive drum 1 shown in FIG. 3 described in the following is a value changeable depending on various conditions, such as an environment, a kind of the recording material P, a resistance value of the transfer roller 5, and the like. Herein, an example of the case where the resistance value of the transfer roller 5 is relatively low is shown. The influence of the resistance value of the transfer roller 5 will be further described in item (6) described later.

First, a state 1 shows the surface potential of the photosensitive drum 1 after the charging (and before the transfer). In the state 1, by the charging roller 2 to which the predetermined charging voltage is applied, the surface of the photosensitive drum 1 is charged substantially uniformly to the predetermined dark-portion potential. In this embodiment, as an example, during the charging, the charging voltage of −1100 V is applied to the charging roller 2, so that the surface of the photosensitive drum 1 is charged to the dark-portion potential Vd of −500 V.

Next, a state 2 shows the surface potential of the photosensitive drum 1 after the transfer (and before the charging). When the recording material P passes through the transfer nip Nt, the transfer voltage of the positive polarity is applied to the transfer roller 5 in the transfer nip Nt. For this reason, the surface potential of the photosensitive drum 1 in the transfer region C lowers. By this, a potential difference is generated between the surface potential of the photosensitive drum in the sheet-passing region D and the surface potential of the photosensitive drum 1 in the non-sheet-passing region E. This is because the recording material P acts as an electric resistor when the toner image is transferred from the photosensitive drum 1, and therefore, the transfer current is liable to concentratedly flow through the non-sheet-passing region E. In this embodiment, as an example, after the transfer, the surface potential of the photosensitive drum 1 in the sheet-passing region D is −400 V, and the surface potential of the photosensitive drum 1 in the non-sheet-passing region E is −270 V. In the state 2, the potential difference between the surface potential of the photosensitive drum 1 in the sheet-passing region D and the surface potential of the photosensitive drum 1 in the non-sheet-passing region E is 130 V.

Next, a state 3 shows the surface potential of the photosensitive drum 1 after re-charging (and before transfer). The surface of the photosensitive drum 1 is charged again by the charging roller 2 in a state in which as described above, the potential difference is generated between the surface potential in the sheet-passing region D and the surface potential in the non-sheet-passing region E. In the state 3, to the charging roller 2, the predetermined charging voltage (−1100 V) is applied similarly as described above. The surface potential of the photosensitive drum 1 after the re-charging returns to the predetermined dark-portion potential Vd (−500 V) in the sheet-passing region D similarly as described above, but is −430 V in the non-sheet-passing region E, so that the surface potential of the photosensitive drum 1 does not return to the predetermined dark-portion potential Vd. In the state 3, the potential difference between the surface potential of the photosensitive drum 1 in the sheet-passing region D and the surface potential of the photosensitive drum 1 in the non-sheet-passing region E is 70 V.

As described above, the surface potential of the photosensitive drum 1 provides the potential difference between the sheet-passing region D and the non-sheet-passing region E.

Next, a method for decreasing the above-described potential difference between the surface potential of the photosensitive drum 1 in the sheet-passing region D and the surface potential of the photosensitive drum 1 in the non-sheet-passing region E will be described. In this embodiment, the above-described potential difference is made small by increasing the charging voltage applied to the charging roller 2.

The surface potential of the photosensitive drum 1 in the state 2 after the transfer is lower in the non-sheet-passing region E than in the sheet-passing region D. For that reason, in the re-charging, in the non-sheet-passing region E in which the potential difference between the photosensitive drum 1 and the charging roller 2 is relatively large, the photosensitive drum surface is charged more than in the sheet-passing region D in which the potential difference between the photosensitive drum 1 and the charging roller 2 is relatively small. In the case where the charging voltage applied to the charging roller 2 is made high, this tendency becomes conspicuous.

For that reason, by increasing the charging voltage applied to the charging roller 2, the potential difference between the surface potential of the photosensitive drum 1 in the sheet-passing region D and the surface potential of the photosensitive drum 1 in the non-sheet-passing region E can be made small.

Figure 4:
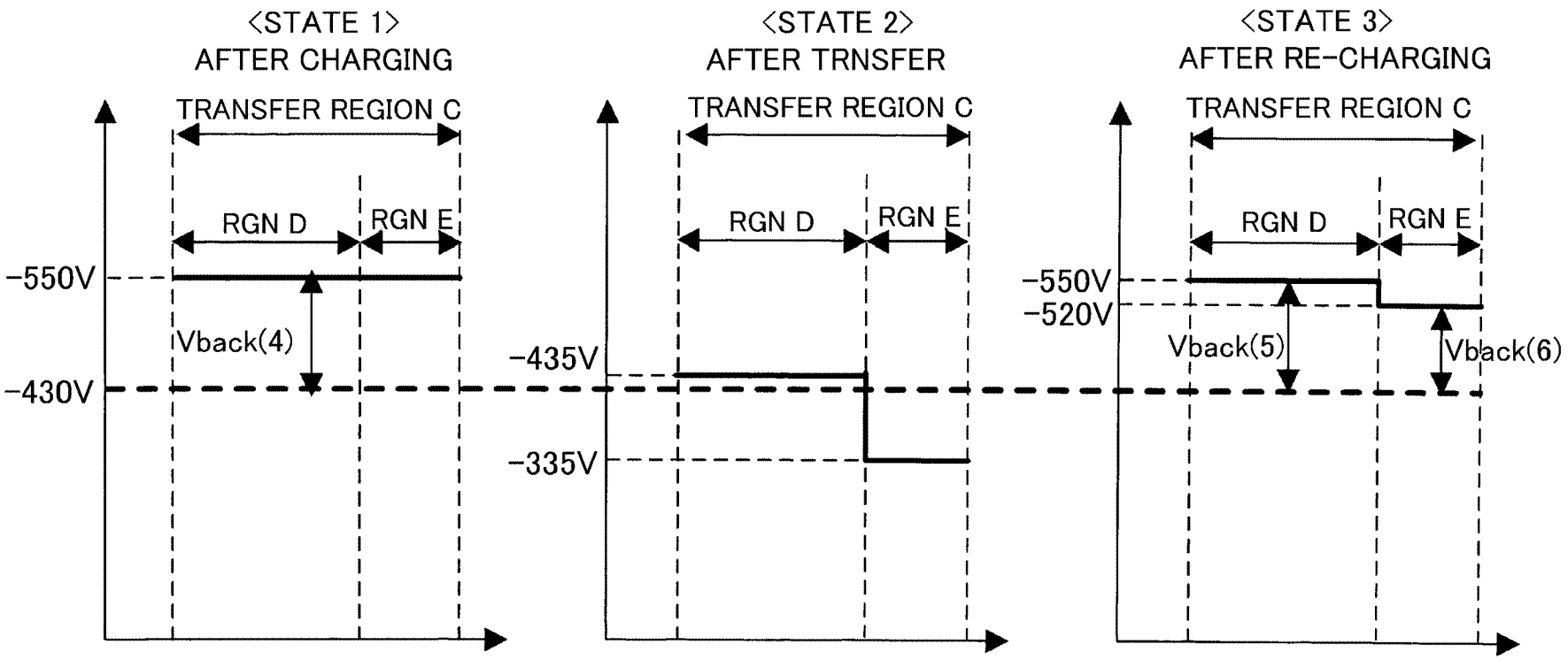
FIG. 4 is a graph for illustrating progression of a surface potential of the photosensitive drum.

FIG. 4 shows progression of the surface potential of the photosensitive drum 1 in the case where the charging voltage applied to the charging roller 2 is made high. Meanings of the abscissa and the ordinate in FIG. 4 are the same as those of the abscissa and the ordinate in FIG. 3, respectively.

First, a state 1 shows the surface potential of the photosensitive drum 1 after the charging (and before the transfer). As an example, to the charging roller 2, a charging voltage of −1150 V is applied. That is, the charging voltage is made higher on the negative (−) side only by 50 V (i.e., the absolute value of the charging voltage of the negative polarity is made larger) compared with the case of FIG. 3. As a result, the surface potential (dark-portion potential) of the photosensitive drum 1 after the charging in the state 1 is −550 V.

Next, a state shows the surface potential of the photosensitive drum 1 after the transfer (and before the charging). Similarly as in the case of FIG. 3, the recording material P passes through the transfer nip Nt, and therefore, a potential difference generates between the surface potential of the photosensitive drum in the sheet-passing region D and the surface potential of the photosensitive drum 1 in the non-sheet-passing region E. However, different from the case of FIG. 3, the surface potential of the photosensitive drum 1 in the sheet-passing region D is −435 V, and the surface potential of the photosensitive drum 1 in the non-sheet-passing region E is −335 V. Thus, the surface potential of the photosensitive drum 1 is made high by increasing the charging voltage, and therefore, the surface potential of the photosensitive drum 1 in the non-sheet-passing region E is higher than that in the case of FIG. 3. In the state 2, the potential difference between the surface potential of the photosensitive drum 1 in the sheet-passing region D and the surface potential of the photosensitive drum 1 in the non-sheet-passing region E is 100 V.

Next, a state 3 shows the surface potential of the photosensitive drum 1 after re-charging (and before transfer). Similarly as in the case of FIG. 3, the surface potential of the photosensitive drum 1 after the re-charging returns to the predetermined dark-portion potential Vd in the sheet-passing region D, but does not return to the predetermined dark-portion potential Vd. However, the charging voltage is made high, and therefore, the surface potential of the photosensitive drum 1 in the non-sheet-passing region E is higher than that in the case of FIG. 3. In the state 3, the surface potential of the photosensitive drum 1 in the sheet-passing region D is −550 V, and the surface potential of the photosensitive drum 1 in the non-sheet-passing region E is −520 V. In the state 3, the potential difference between the surface potential of the photosensitive drum 1 in the sheet-passing region D and the surface potential of the photosensitive drum 1 in the non-sheet-passing region E is 30 V.

As described above, in the case where the charging voltage is made high (FIG. 4), compared with the case where the charging voltage is not made high (FIG. 3), the potential difference between the surface potential of the photosensitive drum 1 in the sheet-passing region D and the surface potential of the photosensitive drum 1 in the non-sheet-passing region E becomes small by 40 V. Thus, the increase in charging voltage is an effective means for decreasing the potential difference between the surface potential of the photosensitive drum 1 in the sheet-passing region D and the surface potential of the photosensitive drum 1 in the non-sheet-passing region E.

(4) End Portion Contamination

Next, the "end portion contamination" will be described. When the potential difference between the surface potential of the photosensitive drum 1 in the sheet-passing region D and the surface potential of the photosensitive drum 1 in the non-sheet-passing region E becomes large, Vback which is a potential difference between the photosensitive drum 1 and the developing roller 4*a* becomes small in the non-sheet-passing region E. This Vback is a potential difference between the dark-portion potential (surface potential of the non-exposure portion) on the photosensitive drum 1 and the potential (developing voltage) of the developing roller 4*a*. Thus, in the case where Vback becomes small in the non-sheet-passing region E, a phenomenon called "fog" such that the toner is deposited on the surface of the photosensitive drum 1 occurs in some instances. Further, in the case where the recording material P is obliquely moved and fed during the transfer or in the like case, the toner deposited on the surface of the photosensitive drum 1 in the non-sheet-passing region E due to the "fog" is deposited on an end portion of the recording material P with respect to a widthwise direction of the recording material P, so that the "end portion contamination" such that the recording material P is contaminated with the toner occurs in some instances.

Figure 5:
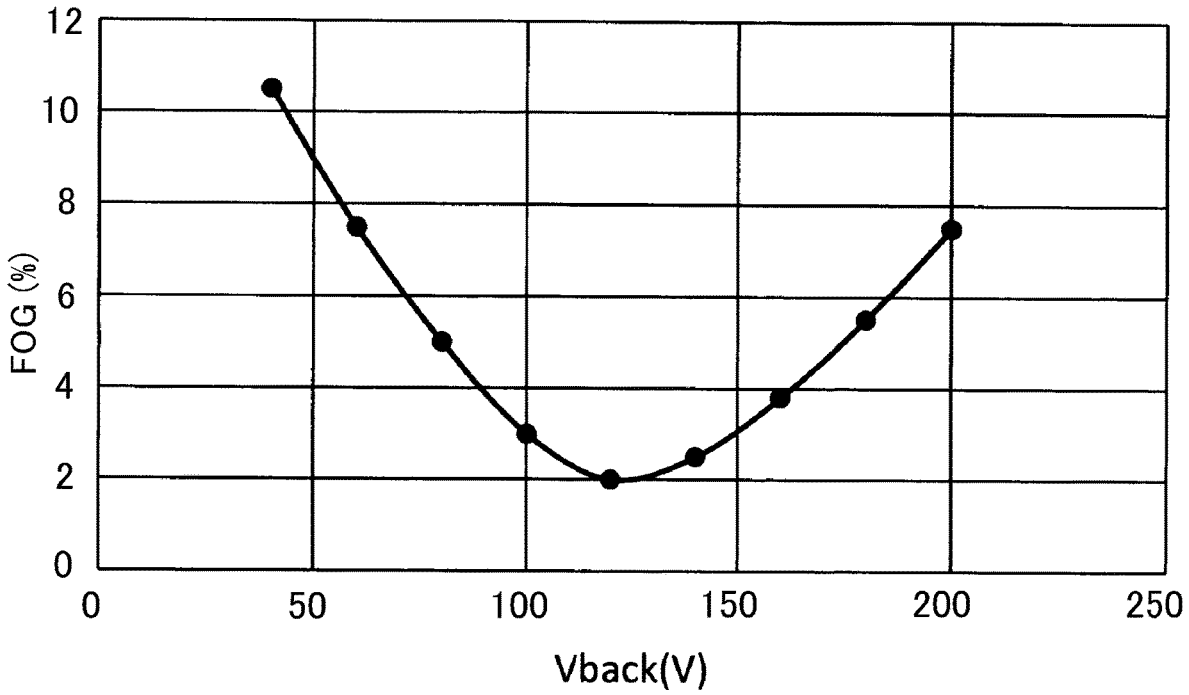
FIG. 5 is a graph showing a relationship between Vback and a fog density.

FIG. 5 shows a relationship between Vback and an occurrence degree of the "fog". Measurement of the fog on the photosensitive drum 1 was made in the following manner. The toner was collected by applying an adhesive surface of a transparent adhesive tape onto the photosensitive drum 1. Then, the adhesive tape was applied onto predetermined paper, and a density (fog density (%)) of the adhesive tape on which the toner was deposited was measured, so that quantification of the fog was performed. In the case where the fog does not occur, the fog density becomes 0%, and as a value of the fog density becomes large, the occurrence degree of the fog is larger, so that the larger fog density value shows that the toner is deposited on the surface of the photosensitive drum 1 in a larger amount. As shown in FIG. 5, in the constitution of this embodiment, the fog occurrence degree is smallest in the case where Vback is about 120 V, and the fog density is 2%. When the fog is in this degree, it is difficult to visually recognize the fog on the recording material P, so that the fog does not become a problem. On the other hand, when Vback becomes smaller than 120 V, the occurrence degree of the fog (ground fog) becomes large, and when the fog density exceeds 6%, visibility of the fog when the fog (toner) is transferred onto the recording material P becomes high, so that a quality of an output product is lowered in some instances.

Here, using FIGS. 3 and 4, the "fog" after the first charging (state 1) and after the re-charging (state 3) will be described. In FIGS. 3 and 4, a thick broken line represents the potential of the developing roller 4*a*, and the potential difference between the surface potential of the photosensitive drum 1 and the potential of the developing roller 4*a* becomes Vback.

First, using FIG. 3, the case where the charging voltage of −1100 V is applied to the charging roller 2 will be described. In the state 1 after the first charging, the surface potential of the photosensitive drum 1 is −500 V substantially uniformly. Further, to the developing roller 4*a*, the developing voltage of −380 V is applied. For that reason, Vback (1) is −120 V substantially uniformly, so that the fog is at a level of no problem. In the state 3 after the re-charging, the surface potential of the photosensitive drum 1 in the sheet-passing region D is −500 V, and therefore, Vback (2) is −120 V and is at a level of no problem similarly as in the case of the state 1. On the other hand, in the state 3 after the re-charging, the surface potential of the photosensitive drum 1 in the sheet-passing region E is −430 V, and therefore, Vback (3) is 50 V and the fog density exceeds 6% (FIG. 5), and therefore, the end portion contamination occurs in some cases.

Next, using FIG. 4, the case where the charging voltage of −1150 V is applied to the charging roller 2 will be described. In the state 1 after the first charging, the surface potential of the photosensitive drum 1 is −550 V substantially uniformly. In this case, in order to make Vback (4) 120 V, to the developing roller 4*a*, the developing voltage of −430 V is applied. For that reason, the fog is at a level of no problem similarly as in the case of FIG. 3 before the change in charging voltage. In the state 3 after the re-charging, the surface potential of the photosensitive drum 1 in the sheet-passing region D is −550 V, and the surface potential of the photosensitive drum 1 in the non-sheet-passing region E is −520 V. In this case, in the state 3, Vback (5) in the sheet-passing region D is 120 V and is at a level of no problem similarly as in the case of the state 1. Further, in the state 3, Vback (6) in the non-sheet-passing region E is 90 V, and the fog density does not exceed 6% (FIG. 5), and therefore, the fog is at a level of no problem.

Thus, by increasing the applied voltage of the charging roller 2, the end portion contamination can be suppressed.

Incidentally, in this embodiment, by increasing the applied voltage of the charging roller 2, the potential difference between the surface potential of the photosensitive drum 1 in the sheet-passing region D and the surface potential of the photosensitive drum 1 in the non-sheet-passing region E was decreased, but the present invention is not limited thereto. By lowering the applied voltage of the developing roller 4*a*, Vback which is the potential difference between the photosensitive drum 1 and the developing roller 4*a* in the non-sheet-passing region E is increased, so that the fog causing the end portion contamination may be reduced. However, when Vback is made large, depending on an amount of the toner contained in the developing device 4 and charged to the opposite polarity to the normal charge polarity, or the like, the toner causes fog (reverse fog) such that the toner is deposited on the non-image portion (non-sheet-passing region) in some cases (see FIG. 5). For that reason, it can be said that the decrease in potential difference between the surface potential of the photosensitive drum 1 in the sheet-passing region D and the surface potential of the photosensitive drum 1 in the sheet-passing region E by increasing the applied voltage of the charging roller 2 is a preferred means.

(5) Image Flow

Next, the image flow will be described. During the charging of the photosensitive drum 1, an electric discharge product such as ozone or NOx generates. In the case of the contact charging type as in this embodiment, compared with a non-contact corona charging type, there is a feature such that a generation amount of the discharge product is small. However, in the case of the contact charging type, a generation position of the discharge product is a minute gap between the photosensitive drum 1 and the charging roller 2. For that reason, the discharge product such as ozone or NOx in a small amount is deposited on the surface of the photosensitive drum 1. The discharge product deposited on the surface of the photosensitive drum 1 absorbs moisture in a high-temperature/high-humidity environment, whereby charge remaining power of the surface of the photosensitive drum 1 lowers. Then, normal charging of the photosensitive drum 1 cannot be made, so that an image defect called "image flow" such that an image density lowers occurs. Further, a deposition amount of the discharge product becomes larger with a longer time in which the charging is made, and therefore, a possibility of occurrence of the image flow becomes higher with an increasing total number of sheets subjected to the formation of the images on the photosensitive drum 1.

As a method of suppressing the image flow, it is possible to cite a method in which the following image flow preventing sequence is performed. The image flow preventing sequence is an operation such that before the image formation is carried out, the photosensitive drum 1 is rotated a relatively large number of times and the number of occurrences of friction of the photosensitive drum 1 with the cleaning blade 6*a* or the like contacting the photosensitive drum 1 is increased, and thus the discharge product is removed from the surface of the photosensitive drum 1. However, when the photosensitive drum 1 is rotated the relatively large number of times by executing such an image flow preventing sequence, a time of the image forming operation becomes long. For that reason, it is desired that a frequency of execution of such an image flow preventing sequence is minimized.

As described above, it would be considered that the potential difference occurring in the transfer nip Nt between the surface potential of the photosensitive drum 1 in the non-sheet-passing region and the surface potential of the photosensitive drum 1 in the sheet-passing region is eliminated by electrically discharging the surface of the photosensitive drum 1 by using the pre-exposure means. However, in this case, an increase in discharge amount to the photosensitive drum 1 during the charging is relatively large, so that the image flow is liable to occur. Also, in the case where the above-described potential difference is made small by increasing the charging voltage as described above, a degree of the increase in discharge amount is smaller than that in the case where the above-described pre-exposure means is used, but the discharge amount to the photosensitive drum 1 in the non-sheet-passing region increases during the charging, and therefore, the image flow is liable to occur. In recent years, lifetime extension of the image forming apparatus 100 advances, so that a tendency such that the discharge amount to the photosensitive drum 1 increases due to long-term use also constitutes a factor such that the image flow is liable to occur.

Thus, from the viewpoint of the discharge amount, the "end portion contamination" and the "image flow" are in a trade-off relationship, and it is desired that these defects are compatibly suppressed.

(6) Resistance Value of Transfer Roller

Next, the influence of the resistance value of the transfer roller 5 on the potential difference between the surface potential of the photosensitive drum 1 in the sheet-passing region and the surface potential of the photosensitive drum 1 in the non-sheet-passing region will be described.

When the resistance value of the transfer roller 5 lowers, the potential difference between the surface potential of the photosensitive drum 1 in the sheet-passing region and the surface potential of the photosensitive drum 1 in the non-sheet-passing region after the transfer becomes large. The reason why the above-described potential difference occurs is because in the case where the recording material P is present in the transfer nip Nt, the transfer current concentratedly flows through the non-sheet-passing region while avoiding the recording material P, which is an electric resistor. This concentration of the transfer current onto the non-sheet-passing region is determined by a relationship between the resistance value of the recording material P and the resistance value of the transfer roller 5. As regards a passage along which the transfer current flows from the transfer roller 5 to the photosensitive drum 1, there are two kinds of passages consisting of a passage along which the transfer current flows toward the photosensitive drum 1 through the recording material P and a passage along which the transfer current flows toward the photosensitive drum 1 not through the recording material P. In the case where the resistance value of the transfer roller 5 is low, the transfer current flows along the latter passage (the passage along which the transfer current flows toward the photosensitive drum 1 not through the recording material P) in which the resistance value is relatively low becomes large. For that reason, in the case where the resistance value of the transfer roller 5 is low, a lower amount of the surface potential of the photosensitive drum 1 in the non-sheet-passing region becomes large.

Accordingly, depending on the resistance value of the transfer roller 5, a magnitude of Vback in the non-sheet-passing region changes, and therefore, a degree of occurrence of the end portion contamination also changes. The resistance value of the transfer roller 5 changes depending on a use situation of the transfer roller 5, such as an environment (at least one of a temperature and a humidity inside or outside of the image forming apparatus 100) or a sheet passing history (for example, a use (operation) amount of the transfer roller 5). For that reason, on the basis of the resistance value of the transfer roller 5, control of a change in image forming condition (the charging voltage or the developing voltage) is carried out, so that it becomes possible to appropriately meet with the end portion contamination. That is, it becomes possible to suppress the end portion contamination while suppressing the image flow.

Here, a method of detecting the resistance value of the transfer roller 5 will be described. In this embodiment, the image forming apparatus 100 detects the resistance value of the transfer roller 5 by utilizing ATVC (auto transfer voltage control). The ATVC is control executed before the recording material P is fed to the transfer nip Nt. The ATVC is executed in the following manner. First, the controller 40 controls the transfer power source 18 to apply an initial voltage to the transfer roller 5 and stands by until output of the initial voltage is stabilized. Thereafter, the controller 40 samples, for a certain time, a detection result of the current flowing through the transfer roller 5 by the transfer current detecting circuit 19, and calculates an average of current values. The controller 40 compares this average value with a preset target current of the ATVC, and changes a voltage subsequently applied to the transfer roller 5 so that a difference therebetween becomes small. By repeating the detection of the current and the change of the voltage, the voltage applied to the transfer roller 5 is controlled so that the average of the detection result of the transfer current detecting circuit 19 converges to the target current of the ATVC. By carrying out the ATVC, the controller 40 is capable of grasping a voltage necessary to cause a predetermined current (typically, the target current of the ATVC) I to flow through the transfer nip Nt. By this, the controller 40 is capable of grasping a resistance value R of the transfer roller 5 from the above-described current (typically, the target current of the ATVC) I and the above-described voltage on the basis of the following formula (1). Thus, in this embodiment, an acquiring portion for acquiring information on the resistance value of the transfer roller 5 is constituted by the transfer current detecting circuit 19, the controller 40, and the like.

$$R=V/I \tag{1}$$

Incidentally, in this embodiment, setting is made so that the initial voltage is 500 V, a stabilization waiting time of the initial voltage is 100 ms, a sampling time of the current is 50 ms, and the target current of the ATVC is 3 μA.

Further, the controller 40 functions as a transfer voltage detecting means and is capable of detecting (grasping) a voltage value of the voltage applied to the transfer roller 5 on the basis of a voltage output instruction to the transfer power source 18. However, for example, a transfer voltage detecting circuit as the transfer voltage detecting means is provided in the transfer power source 18 or the like, and the controller 40 may acquire a voltage value of a voltage applied from the transfer voltage detecting circuit to the transfer roller 5.

Further, the controller 40 acquires a voltage-current characteristic, represented by a rectilinear line or a curved line, on the basis of an applied voltage and a detection current and may acquire a necessary voltage for permitting a flow of a predetermined current on the basis of this characteristic (relationship). Further, on the basis of this characteristic, it is possible to acquire the resistance value of the transfer roller 5. The number of measuring points for acquiring the characteristic is typically a plurality of points, but a single measuring point may be employed by utilizing 0 (zero) point.

Further, the controller 40 may determine the transfer voltage for during the transfer by adding a recording material part voltage set in advance depending on the kind of the recording material P to the voltage V necessary to cause the predetermined current I acquired by the ATVC to flow through the transfer nip Nt. Then, during the transfer the controller 40 is capable of subjecting the transfer voltage to constant-voltage control with the above-determined value at least in a part of a period in which the recording material P passes through the transfer nip Nt.

Here, the resistance value of the transfer roller 5 gradually increases due to deterioration of the elastic layer of the transfer roller 5 through repetitive application of the voltage. For that reason, the end portion contamination generating in the case where the potential difference between the surface potential of the photosensitive drum 1 in the sheet-passing region and the surface potential of the photosensitive drum 1 in the non-sheet-passing region is large is liable to generate in the case where the state of the transfer roller 5 is close to a fresh (new) state in which the resistance value of the transfer roller 5 is low.

(7) Control of Image Forming Condition

In this embodiment, in view of the above-described mechanisms and factors, on the basis of the resistance value of the transfer roller 5, control of a change in image forming condition (the charging voltage or the developing voltage) is carried out.

Figure 6:
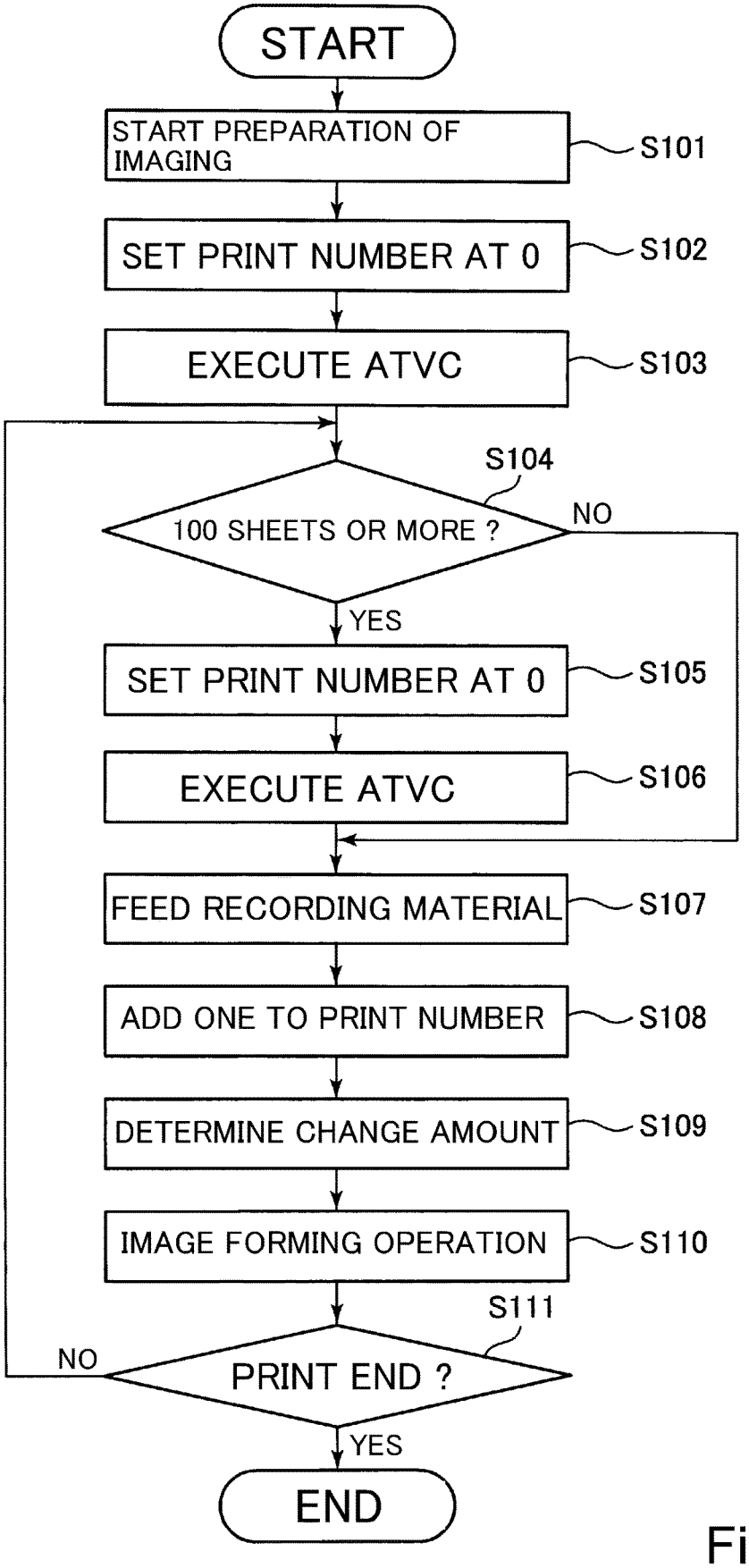
FIG. 6 is a flowchart of control in an embodiment 1.

FIG. 6 is a flowchart showing an outline of procedure of the control of the change in image forming condition on the basis of the resistance value of the transfer roller 5. Processing of FIG. 6 is actuated when the image forming apparatus 100 receives information on a print job, and is executed by the controller 40 (specifically, the CPU 41).

First, the controller 40 executes preparation of the image formation by receiving the information on the print job (S101). Specifically, the controller 40 causes a motor to drive, so that various rotatable members (the photosensitive drum 1, various rollers, and the like) in the image forming apparatus 100 are driven and electric power is supplied to a heater of the fixing device 12, and thus pre-heating of the fixing device is carried out. Next, the controller 40 sets, at an initial value (0 in this embodiment), a count (value), for the number of sheets subjected to the image formation (print number), of a counter provided in the RAM 41*b* in this embodiment (S102). In this embodiment, the controller 40 causes the RAM 41*b* to sequentially update and store the count by adding 1 to the count of the print number every formation of the image on one side of the recording material P (i.e., every supply of the recording material P to the transfer nip Nt). Then, the controller 40 executes the ATVC and detects the resistance value of the transfer roller 5 (S103). Then, the controller 40 discriminates whether or not the count of the print number in the RAM 41*b* is 100 or more (S104). In the case where the controller 40 discriminated in S104 that the count of the print number is less than 100, the sequence goes to processing of S107. Further, in the case where the controller 40 discriminated in S104 that the count of the print number is 100 or more, the feeding of the recording material P is once stopped, and the sequence goes to S107 through processing of S105 and processing of S106. That is, the controller 40 resets the count of the print number to the initial value (0 in this embodiment) (S105) and executes the ATVC again (S106), and then the sequence goes to the processing of S107. Here, in this embodiment, the reason why a threshold of the count of the print number is set at 100 is as follows. That is, in the constitution of this embodiment, when continuous image formation of 100 sheets or more is carried out, by the influence of temperature rise in the image forming apparatus 100, the resistance value of the transfer roller 5 lowers to the extent that the resistance value of the transfer roller 5 has the influence on the end portion contamination in some instances, and therefore, there is a need to measure the resistance value of the transfer roller 5 again.

The controller 40 causes the feeding portion to start the feeding of the recording material P to the transfer nip Nt (S107), and thereafter, causes the counter to add 1 to the count of the print number in the RAM 41*b* (S108). Then, on the basis of the resistance value of the transfer roller 5 acquired in S103 or S106, the controller 40 determines an image forming condition such as the transfer voltage, the charging voltage, the developing voltage, or the like (S109). Specifically, in this embodiment, in the case where the resistance value of the transfer roller 5 is not more than a predetermined threshold set in advance, the controller 40 increases the charging voltage and correspondingly increases the developing voltage so as to maintain Vback. A specific example of the image forming condition will be described later. Then, the controller 40 performs the image forming operation on the determined image forming condition (S110). Then, the controller 40 discriminates whether or not all the image outputs designated by the print job are ended (S111), and in the case where the controller 40 discriminated that the outputs are not ended, the sequence returns to the processing of S104, and in the case where the controller 40 discriminated that the outputs are ended, the controller 40 ends the print job.

(8) Effect

Next, an effect of this embodiment will be further described by a specific example of a change in image forming condition. Here, by using the image forming apparatus 100 having the constitution of this embodiment, the end portion contamination and the image flow were evaluated in an environment of normal-temperature/normal-humidity (23° C./50% RH). As regards the end portion contamination, continuous image formation of 500 sheets was carried out, and a degree of contamination with toner of an end portion of the recording material P with respect to the widthwise direction was evaluated. As regards the image flow, image formation was repetitively carried out with intervals, so that the image formation of 10000 sheets in total was carried out. Thereafter, a degree of lowering in image density when a half-tone image was formed was evaluated. Further, the above-described evaluations were performed by double-side image formation in which the end portion contamination is liable to occur. In the case where the double-side image formation is carried out, the recording material P warmed in the fixing step of the image on a first side is supplied to the transfer nip Nt for the transfer of the image on a second side.

For that reason, in the case where the double-side image formation is continuously carried out, the transfer roller 5 is liable to be warmed and thus the resistance value of the transfer roller 5 is liable to be lowered, so that the image forming apparatus 100 is easily put in a state in which the end portion contamination is liable to occur. Further, as the recording material P, paper ("GF-0081" (trade name), manufactured by Canon K.K.) was used. Further, as the transfer roller 5, a transfer roller 5 of which resistance value was $2.0\times10^{8}\Omega$ in the case where the image forming apparatus 100 was left standing at an initial stage of use (at the time of brand-new state) in the normal-temperature/normal-humidity environment was used. A table 1 below shows the resistance value of the transfer roller 5 detected when the ATVC was carried out for each 100 sheets.

TABLE 1

| SHEET | RESISTANCE VALUE (Ω) |
|---|---|
| 1st | $2.0 \times 10^8$ |
| 101st | $1.6 \times 10^8$ |
| 201st | $1.3 \times 10^8$ |
| 301st | $1.1 \times 10^8$ |
| 401st | $1.0 \times 10^8$ |

A table 2 appearing hereinafter shows an image forming condition and an evaluation result in the case where image formation of 500 sheets from 1st sheet to 500th sheet was carried out in the image forming apparatus 100 of this embodiment (embodiment 1) and image forming apparatuses 100 of comparison examples 1 and 2. Constitutions and operations of the image forming apparatuses 100 of the comparison examples 1 and 2 are substantially the same as those of the image forming apparatus 100 of this embodiment. Also, the comparison examples 1 and 2 will be described by adding the same reference numerals or symbols as those in this embodiment. In the table 2, as regards the end portion contamination, the case where a fog density value in the non-sheet-passing region is less than 6% is represented by "○(good)", and the case where the fog density value is 6% or more is represented by "x (poor)". Further, in the table 2, as regards the image flow, the case where a density lowering did not occur is represented by "○ (good)", and the case where the density lowering occurred is represented by "x (poor)".

TABLE 2

| | 1st-200th | | 201st-500th | | EVALUATION*3 | |
|---|---|---|---|---|---|---|
| | CV*1(V) | DV*2(V) | CV*1(V) | DV*2(V) | EPC*4(V) | IF*5(V) |
| EMB.1 | −1100 | −380 | −1200 | −480 | ○ | ○ |
| COMP.EX.1 | −1100 | −380 | −1100 | −380 | X | ○ |
| COMP.EX.2 | −1100 | −480 | −1200 | −480 | ○ | X |

*1"cV" is the charging voltage.
*2"DV" is the developing voltage.
*3"EVALUATION" is an evaluation result.
*4"EPC" is the end portion contamination.
*5"IF" is the image flow.

The comparison example 1 is an example in which on the basis of the resistance value of the transfer roller 5, the image formation was carried out without changing the image forming condition. In this case, when continuous image formation is carried out, the resistance value of the transfer roller 5 is lowered, and therefore, the potential difference between the surface potential of the photosensitive drum 1 in the sheet-passing region and the surface potential of the photosensitive drum 1 in the non-sheet-passing region gradually becomes large. In this case, Vback becomes small in the non-sheet-passing region, and therefore, the end portion contamination occurs. On the other hand, in the comparison example 1, the change in image forming condition such that the discharge amount increases is not made, and therefore, the image flow does not occur.

The comparison example 2 is an example in which in order to suppress the end portion contamination, the charging voltage is always increased from the initial state during the charging. In this case, even when the resistance value of the transfer roller 5 becomes low, the photosensitive drum 1 is charged by a high charging voltage, and therefore, the potential difference between the surface potential of the photosensitive drum 1 in the sheet-passing region and the surface potential of the photosensitive drum 1 in the non-sheet-passing region can be made small. For that reason, the end portion contamination does not occur. However, as a result that the charging voltage is always increased from the initial state during the charging, a density lowering due to the image flow occurred. For that reason, in the comparison example 2, there is a need to perform the image flow preventing sequence as described above.

On the other hand, in this embodiment, the resistance value of the transfer roller 5 is detected by the ATVC, and the control of changing the image forming condition on the basis of a detection result thereof is carried out. The resistance value of the transfer roller 5 was detected as $1.3\times10^8$ Ω by the ATVC after the image formation of 200 sheets, and therefore, at the time of the 201st sheet and later at which there is a possibility that the end portion contamination occurs, control of increasing the charging voltage and the developing voltage was carried out. That is, in this embodiment, in the process of S109, the controller 40 increased the charging voltage and the developing voltage in the case where the resistance value of the transfer roller 5 is not more than $1.3\times10^8$ Ω as the predetermined threshold set in advance. As a result, the end portion contamination did not occur. Further, in this embodiment, the change in image forming condition was not made in the initial state in which the resistance value of the transfer roller 5 was high, and therefore, a level of the image flow was better than that in the comparison example 2, so that the image flow did not occur.

In this embodiment, on a side downstream of the transfer roller Pd and upstream of the charging position Pa with respect to the rotational direction of the photosensitive drum 1, the image forming apparatus 100 does not include the pre-exposure means for exposing the photosensitive drum 1 to light. In the case where the surface potential difference of the photosensitive drum 1 is decreased by increasing the charging voltage, compared with the case where the surface potential difference of the photosensitive drum 1 is eliminated by using the pre-exposure means, an increase in discharge amount to the photosensitive drum 1 during the charging is small, so that the image flow does not readily occur. Further, in this embodiment, the control of the change in charging voltage is carried out on the basis of the resistance value of the transfer roller 5, so that the discharge amount to the photosensitive drum 1 is not unnecessary increased. For that reason, according to this embodiment, it becomes easy to compatibly realize suppression of the "end portion contamination" and suppression of the "image flow". Further, according to this embodiment, compared with the above-described case of using the pre-exposure means, the constitution can be simplified and downsized. Thus, according to this embodiment, by a simple constitution, the end portion contamination can be suppressed while suppressing the image flow.

Incidentally, in this embodiment, the threshold is provided for the resistance value of the transfer roller 5, and the change in image forming condition was made in the case where the detected resistance value of the transfer roller 5 is the threshold or less, but the present invention is not limited thereto. The image forming condition may be changed in multiple stages on the basis of the detection result of the resistance value of the transfer roller 5. For example, with a decreasing resistance value of the transfer roller 5, the charging voltage is increased stepwise, and correspondingly, the developing voltage is increased so as to maintain Vback.

Further, in this embodiment, the change in image forming condition was made by changing the charging voltage and the developing voltage in interrelation with each other so that the fog is not worsened, but the present invention is not limited thereto. For example, the charging voltage and the developing voltage may be changed individually. Further, only either one of the charging voltage and the developing voltage may be changed.

Further, in this embodiment, progression of the resistance value of the transfer roller 5 was detected by periodically performing the ATVC during the image formation, but the present invention is not limited thereto. For example, the print number during the continuous image formation is counted in advance, and from the print number and the resistance value of the transfer roller 5 detected using the ATVC in the pre-rotation step, a present resistance value of the transfer roller 5 may be estimated. For example, the resistance value of the transfer roller 5 can be predicted on the basis of the information on the progression of the resistance value of the transfer roller 5 acquired in advance as shown in the table 1.

Further, in this embodiment, the resistance value of the transfer roller 5 was grasped by utilizing the ATVC, but the present invention is not limited thereto. For example, information on the resistance value of the transfer roller 5 measured in advance is stored in advance in a nonvolatile memory as a strong means of the image forming apparatus 100, and then the resistance value of the transfer roller 5 may be detected by a simpler method. That is, for example, a use amount (use amount from the brand-new state, use amount from an initial state of the continuous image formation) of the transfer roller 5 and a resistance value of the transfer roller 5 depending on an environment, which are measured in advance can be stored in the nonvolatile memory of the image forming apparatus 100. Then, the controller 40 is capable of estimating the present resistance value of the transfer roller 5 depending on the present use amount and the present environment of the transfer roller 5. Incidentally, the use amount of the transfer roller 5 may be an arbitrary index value correlating with a lapse of time with the use of the transfer roller 5, such as the print number or the number of rotations (rotation time) of the transfer roller 5. In this case, the acquiring portion for acquiring the information on the resistance value of the transfer roller 5 is constituted by the nonvolatile memory, the controller, and the like.

Further, in this embodiment, as the information on the transfer roller 5, the resistance value acquired from the current value and the voltage value was used, but a value correlating with the resistance value, such as the current value or the voltage value may be used.

Thus, in this embodiment, the image forming apparatus 100 includes the rotatable photosensitive member 1, the charging member 2 for charging the surface of the photosensitive member 1, the charging power source 21 for applying the charging voltage to the charging member 2 during the charging, the developing member 4*a* for forming the toner image by supplying the toner to the charged surface of the photosensitive member 1, the transfer member 5 for forming the transfer portion Nt in contact with the surface of the photosensitive member 1 and for transferring the toner image from the surface of the photosensitive member 1 onto the recording material P passing through the transfer portion Nt, the transfer power source 18 for applying the transfer voltage to the transfer member 5, the acquiring portion (the transfer current detecting circuit 19, the controller 40) for acquiring the information on the electric resistance value of the transfer member 5, and the controller 40 capable of controlling the charging power source 21, wherein the controller 40 carries out control so that the charging voltage applied in the image forming operation for forming the toner image on the recording material P is a first charging voltage in the case where the electric resistance value of the transfer member 5 indicated by the information acquired by the acquiring portion is a first resistance value and so that the charging voltage applied in the image forming operation is a second charging voltage larger in absolute value than the first charging voltage in the case where the electric resistance value of the transfer member 5 indicated by the information acquired by the acquiring portion is a second resistance value lower than the first resistance value. In this embodiment, the acquiring portion acquires information on the electric resistance value of the transfer member 5 on the basis of at least one of the voltage value of the voltage applied to the transfer member 5 and the current value of the current flowed through the transfer member 5 when the voltage is applied to the transfer member 5 by the transfer power source 18 during absence of the recording material P in the transfer portion Nt. Further, in this embodiment, the image forming apparatus 100 includes the developing power source 16 for applying the developing voltage to the developing member 4*a* during the toner image formation, wherein the controller 40 carries out control so that the developing voltage is a first developing voltage in the case where the charging voltage is the first charging voltage and so that the developing voltage is a second developing voltage larger in absolute value than the first developing voltage in the case where the charging voltage is the first charging voltage. Further, in this embodiment, the controller 40 changes the developing voltage with the change in charging voltage so that a difference between the charging voltage and the developing voltage is substantially constant. Incidentally, the controller 40 may carry out control so that the developing voltage applied in the image forming operation for forming the toner image on the recording material P is the first developing voltage in the case where the electric resistance value of the transfer member 5 indicated by the acquiring portion is the first resistance value and so that the developing voltage applied in the image forming operation is the second developing voltage smaller in absolute value than the first developing voltage in the case where the electric resistance value of the transfer member 5 indicated by the information acquired by the acquiring portion is the second resistance value lower than the first resistance value. Further, in this embodiment, the image forming apparatus 100 is not provided with the pre-exposure portion for exposing the surface of the photosensitive member 1 to light on a side, with respect to the rotational direction of the photosensitive member 1, downstream of the transfer position Pd where the transfer is executed and upstream of the charging position Pa where the charging is executed.

As described above, in this embodiment, the charging voltage is increased on the basis of the resistance value of the transfer roller 5. By this, while suppressing the image flow, the end portion contamination can be suppressed.

Next, another embodiment (embodiment 2) of the present invention will be described. Basic constitution and operation of an image forming apparatus of this embodiment are the same as of the image forming apparatus in the embodiment 1. Accordingly, in the image forming apparatus of this embodiment, elements having the same or corresponding functions or constitutions to those of the image forming apparatus in the embodiment 1 will be omitted from detailed description by adding the same reference numeral or symbols as those in the embodiment 1.

In the embodiment 1, by changing the image forming condition on the basis of the resistance value of the transfer roller 5, the end portion contamination was suppressed while suppressing the image flow. In this embodiment, by further changing the image forming condition on the basis of the resistance value of the recording material P used in the image formation, not only the end portion contamination is suppressed, but also an increase in margin for suppression of the image flow is realized. Here, the influence of the resistance value of the recording material P on the potential difference between the surface potential of the photosensitive drum 1 in the sheet-passing region and the surface potential of the photosensitive drum 1 in the non-sheet-passing region will be described.

In the case where the resistance value of the recording material P is high, the potential difference between the surface potential of the photosensitive drum 1 in the sheet-passing region and the surface potential of the photosensitive drum 1 in the non-sheet-passing region after the transfer becomes large. The reason why the above-described potential difference is because in the case where the recording material P is present in the transfer nip Nt, the transfer current concentratedly flows through the non-sheet-passing region while avoiding the recording material P which is an electric resistor. In the case where the resistance value of the recording material P is high, a ratio of the current flowing through the non-sheet-passing region to the current flowing through the sheet-passing region becomes relatively large, and therefore, a lower amount of the surface potential of the photosensitive drum 1 in the non-sheet-passing region becomes large.

Accordingly, also, depending on the resistance value of the recording material P, similarly as in the case of the resistance value of the transfer roller 5 described in the embodiment 1, a magnitude of Vback in the non-sheet-passing region changes, and therefore, a degree of occurrence of the end portion contamination also changes. The resistance value of the recording material P changes depending on a state of the recording material P, such as a thickness or a material of the recording material P, an environment (at least one a temperature and a humidity inside or outside of the image forming apparatus 100) or a sheet passing history (for example, whether the side of the double-side image formation is the first side or the second side). For that reason, on the basis of the resistance value of the recording material P, control of a change in image forming condition (the charging voltage or the developing voltage) is carried out, so that it becomes possible to appropriately meet with the end portion contamination. That is, it becomes possible to suppress the end portion contamination while suppressing the image flow.

The resistance value of the recording material P can be detected in the following manner, for example. That is, a resistance value of the transfer nip Nt in which the recording material P is nipped is detected on the basis of the voltage value of the applied voltage and the current value of the current flowing through the transfer roller 5 when the recording material P passes through the transfer nip Nt. Then, on the basis of a difference between this resistance value and a resistance value (resistance value during the absence of the recording material P in the transfer nip Nt) of the transfer roller 5 detected by the ATVC, it is possible to detect the resistance value of the recording material P. In the case where the difference in resistance value is large, it can be said that the recording material P is a recording material P high in resistance value. Incidentally, there is a case that the resistance value of the recording material P cannot be detected depending on the presence or absence of the toner on the recording material P, and therefore, detection of the resistance value of the transfer nip Nt in which the recording material P is nipped may preferably be performed in a margin portion on a leading end side with respect to the recording material P feeding direction. In this embodiment, the recording material P with the resistance value of $1.0\times10^{10}$ Ω or more is discriminated as the recording material P high in resistance value. Thus, in this embodiment, similarly as the acquiring portion for acquiring the information on the resistance value of the transfer roller 5 in the embodiment 1, another acquiring portion for acquiring information on the resistance value of the recording material P is constituted by the transfer current detecting circuit 19, the controller 40, and the like.

Figure 7:
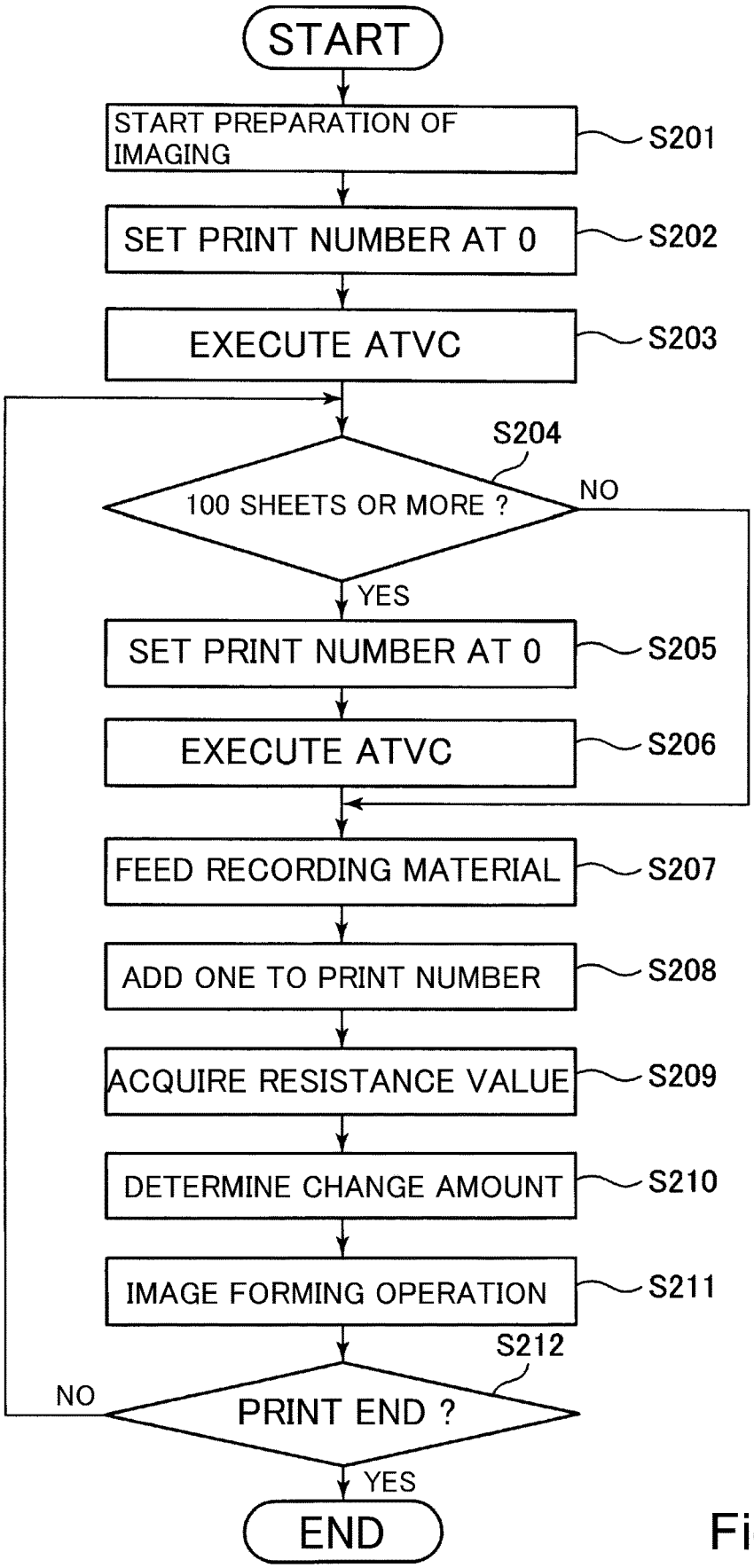
FIG. 7 is a flowchart of control in an embodiment 2.

FIG. 7 is a flowchart showing an outline of procedure of the control of the change in image forming condition on the basis of the resistance value of the transfer roller 5 and the resistance value of the recording material P. Processing of FIG. 7 is actuated when the image forming apparatus 100 receives information on a print job, and is executed by the controller 40 (specifically, the CPU 41).

Processes S201 to S208 in FIG. 7 are the same as the processes S101 to S108 of FIG. 6 in the embodiment 1, respectively. In this embodiment, the controller 40 acquires information on the resistance value of the recording material P in S209. As described above, in this embodiment, the controller 40 discriminates whether or not the resistance value of the recording material P is high, on the basis of a detection result of the resistance value when the margin portion of the recording material P with respect to the recording material feeding direction passes through the transfer nip Nt and a detection result of the resistance value of the transfer roller 5 by the ATVC in S203 or S206. Specifically, in this embodiment, the controller 40 discriminates that the resistance value of the recording material P is high in the case where the resistance value of the recording material P is not less than $1.0\times10^{10}$ Ω as the predetermined threshold set in advance as described above. Incidentally, the image forming condition may be changed on the basis of a detection result of the resistance value from the image formation of the image on the recording material P for which the information on the resistance value of the recording material P is acquired. However, in the case where the control of the image forming condition is not in time or in the like case, on the basis of the detection result, for example, the image forming condition in the image formation from image formation of the image on a subsequent recording material P until the resistance value of the recording material P is subsequently detected may be used.

Then, on the basis of the information on the resistance value of the transfer roller 5 acquired in S203 or S206 and the information on the resistance value of the recording material P acquired in S209, the controller 40 determines an image forming condition such as the transfer voltage, the charging voltage, the developing voltage, or the like (S210). Specifically, in this embodiment, in the case where the resistance value of the transfer roller 5 is not more than a predetermined threshold set in advance, the controller 40 increases the charging voltage and correspondingly increases the developing voltage so as to maintain Vback. At this time, in this embodiment, setting of the charging voltage is made different depending on whether or not the recording material P is the recording material P high in resistance value. A specific example of the image forming condition will be described later. Then, the controller 40 performs the image forming operation on the determined image forming condition (S211). Then, the controller 40 discriminates whether or not all the image outputs designated by the print job are ended (S212), and in the case where the controller 40 discriminated that the outputs are not ended, the sequence returns to the processing of S204, and in the case where the controller 40 discriminated that the outputs are ended, the controller 40 ends the print job.

Next, an effect of this embodiment will be further described by a specific example of a change in image forming condition. Here, by using the image forming apparatus 100 having the constitution of this embodiment, the end portion contamination was evaluated in the environment of normal-temperature/normal-humidity (23° C./50% RH). In order to confirm the effect in the case where the resistance value of the recording material P is different, as the recording material P, by using the thin recording material P (low in resistance value) and a thick recording material P (high in resistance value), image formation was carried out for each 500 sheets. As the thin recording material P, paper ("CS-068" (trade name), manufactured by Canon K.K.) was used, and as the thick recording material P, paper ("GF-0081" (trade name), manufactured by Canon K.K.) was used.

In the embodiment 1, the image formation is carried out without contacting the image forming condition on the basis of the resistance value of the recording material P. In this case, as described in the embodiment 1, the charging voltage applied to the charging roller 2 was set at −1200 V for the 201st sheet and later in which the resistance value of the transfer roller 5 became low. By increasing the charging voltage in the case where the resistance value of the transfer roller 5 became low, the end portion contamination did not occur.

Further, in this embodiment, in the case of the recording material P thin in thickness and low in resistance value (in the case where the resistance value of the recording material P is less than the predetermined threshold, the charging voltage was made lower than the charging voltage in the embodiment 1). In this embodiment, in the case of the recording material P thin in thickness and low in resistance value, for the 201st sheet and later, the charging voltage applied to the charging roller 201 was changed to −1150 V lower than the charging voltage in the embodiment 1. In this case, although the resistance value of the transfer roller 5 lowered, the resistance value of the recording material P was low, and therefore, the end portion contamination did not occur. Further, in this embodiment, compared with the embodiment 1, the charging voltage is made small in the case of the recording material P thin in thickness and low in resistance value, and therefore, in the case where the image is formed on such a recording material P, a total discharge amount to the photosensitive member 1 becomes small. As a result, in the case where the image is formed on such a recording material P, suppression of the image flow becomes easier. That is, a margin for the image flow increases.

Incidentally, in this embodiment, the threshold is provided for the resistance value of the recording material P, and the change in image forming condition was made in the case where the detected resistance value of the recording material P is less than the threshold, but the present invention is not limited thereto. The image forming condition may be changed in multiple stages on the basis of the detection result of the resistance value of the recording material P. For example, with an increasing resistance value of the recording material P, the charging voltage is increased stepwise, and correspondingly, the developing voltage can be increased so as to maintain the Vback.

Further, in this embodiment, the image forming condition was changed on the basis of the detection result of the resistance value of the recording material P, but the present invention is not limited thereto. The image forming condition may be changed on the basis of the resistance value of the recording material P estimated from the information on the state of the recording material P, such as information on the thickness of the recording material P, the information on the environment, the information on a standing state of the recording material, and the like. In this case, on the basis of the above-described information, the change in image forming condition can be controlled for each (one) recording material P fed to the transfer nip Nt. Incidentally, the information on the thickness of the recording material P is an example of the information on the kind of the recording material P. The information on the recording material P include arbitrary pieces of information capable of discriminating the recording material P, such as attributes (so-called paper kind category) based on general features, such as plain paper, thick paper, and thin paper, numerical values or numerical value ranges, such as a basis weight, the thickness, the size, and rigidity; or brands (including a manufacturer, a trade name, a product number, and the like). For each recording material P discriminated by the information on the recording material P, it can be regarded that the kind of the recording material P is constituted. The controller 40 is a capable of acquiring the information on the kind of the recording material P from information on a print job inputted from the external device to the image forming apparatus 100 and information inputted through the operating portion provided on the image forming apparatus 100. The information on the recording material P may be included in information for designating operation setting of the image forming apparatus 100, such as "plain paper mode", or "thick paper mode", or may be replaced with such information, for example.

Further, the information on the resistance value of the recording material P such as the thickness and the resistance value of the recording material P may be acquired by a media sensor provided in the feeding passage of the recording material P from the feeding portion of the recording material P to the transfer nip Nt. As the media sensor, a media sensor which is capable of being used for detecting or estimating the basis weight correlating with the thickness of the recording material P, a surface property of the recording material P, and a water content of the recording material P and which uses light, ultrasonic wave, or the like has been known. Further, a mechanism (electroconductive roller pair, power source, and the like) capable of detecting the resistance value of the recording material P from the current value and the voltage value when the voltage is applied similarly as in the above-described ATVC may be provided in the feeding passage of the recording material P from the feeding portion of the recording material P to the transfer nip Nt. Further, on the basis of the information acquired by the above-described media sensor, the change in image forming condition may be controlled for each (one) recording material P fed to the transfer nip Nt.

Further, in the case where the double-side image formation is carried out, the resistance value of the recording material P when the image is formed on the second side is higher than the resistance value of the recording material P when the image is formed on the first side. This is because water content of the recording material P is vaporized by the fixing operation in the formation of the image on the first side. By utilizing this, the resistance value of the recording material P is discriminated depending on whether the image is formed on the first side or the second side, and then, the change in image forming condition may be made. For example, during the formation of the image on the second side, the charging voltage is made higher than the charging voltage during the formation of the image on the first side, and correspondingly, the developing voltage can be increased so as to maintain the Vback.

Further, as described in the embodiment 1, by lowering the applied voltage of the developing roller 4*a*, the Vback which is the potential difference between the photosensitive drum 1 and the developing roller 4*a* in the non-sheet-passing region is made large, so that the fog causing the end portion contamination may be reduced. For example, the developing voltage can be made low in place of the increase in charging voltage in the case where the resistance value of the transfer roller 5 lowered in the above-described specific example in this embodiment. Further, the developing voltage can be made high in place of the decrease in charging voltage in the case where the resistance value of the recording material P is low in the above-described specific example.

Thus, in this embodiment, similarly as in the embodiment 1, the controller 40 carries out control so that the charging voltage is the first charging voltage in the case where the electric resistance value of the transfer member 5 indicated by the information acquired by the acquiring portion (the transfer current detecting circuit 19, the controller 40) is the first resistance value and so that the charging voltage is the second charging voltage higher in absolute value than the first charging voltage in the case where the electric resistance value of the transfer member 5 indicated by the information acquired by the acquiring portion is the second resistance value lower than the first resistance value.

Further, in this embodiment, the image forming apparatus 100 includes another acquiring portion (the transfer current detecting circuit 19, the controller 40) for acquiring the information on the electric resistance value of the recording material P, and in the case where the electric resistance value of the transfer member 5 indicated by the information acquired by the above-described acquiring portion is the above-described second resistance value, the controller 40 carries out control so that the charging voltage is the above-described second charging voltage in the case where the electric resistance value of the recording material P indicated by the information acquired by the above-described another acquiring portion is the above-described third resistance value and so that the charging voltage is a third charging voltage lower in absolute value than the second charging voltage in the case where the electric resistance value of the recording material P indicated by the information acquired by the above-described another acquiring portion is a fourth resistance value lower than the third resistance value. Incidentally, in the case where the electric resistance value of the transfer member 5 indicated by the information acquired by the above-described acquiring portion is the above-described second resistance value, the controller 40 carries out control so that the developing voltage is a second developing voltage in the case where the electric resistance value of the recording material P indicated by the information acquired by the above-described another acquiring portion is the third resistance value and so that the developing voltage is a third developing voltage higher in absolute value than the above-described second developing voltage in the case where the electric resistance value of the recording material P indicated by the information acquired by the above-described another acquiring portion is the fourth resistance value lower than the third resistance value.

In this embodiment, the above-described another acquiring portion acquires the information on the kind of the recording material P on the basis of at least one of the voltage value of the voltage applied to the transfer member 5 and the current value of the current passed through the transfer member 5 when the voltage is applied to the transfer member 5 by the transfer power source 18 during the absence of the recording material P in the transfer nip Nt and on the basis of at least one of the voltage value of the voltage applied to the transfer member 5 and the current value of the current flowed through the transfer member 5 when the voltage is applied to the transfer member 5 by the transfer power source 18 during the presence of the recording material P in the transfer nip Nt. However, the above-described another acquiring portion may acquire the information on the electric resistance value of the recording material P on the basis of the information on the kind of the recording material P. In this case, the information on the kind of the recording material P may include information on the thickness of the recording material P. Further, the above-described another acquiring portion may acquire the information on the resistance value of the recording material P on the basis of the information on whether in the double-side image formation, the image is formed on the first side or the second side.

As described above, in this embodiment, in addition to the change in image forming condition based on the resistance value of the transfer roller 5, the image forming condition is changed on the basis of the resistance value of the recording material P. By this, not only the end portion contamination is suppressed, but also for suppressing the image flow, it becomes possible to realize the increase in margin.

As described above, the present invention was described based on the specific embodiments, but the present invention is not limited thereto.

In the above-described embodiments, the case where the transfer member is the transfer roller was described, but the transfer member is not limited to the transfer roller. The transfer member may be constituted by, for example, including a rotatable endless belt contactable to the photosensitive member. On an inner peripheral surface side of this transfer belt, in a position opposing the photosensitive member, a voltage applying member (roller, brush, sheet, or the like) for supplying the transfer voltage to the transfer portion through the transfer belt may be disposed.

Further, in the above-described embodiments, the case where the photosensitive member is the photosensitive drum was described, but the photosensitive member is not limited to the photosensitive drum. The photosensitive member may also be a photosensitive (member) belt constituted in an endless belt shape.

Further, in the above-described embodiments, the image forming apparatus was not provided with the pre-exposure means, but the present invention is not limited thereto. The present invention is applicable to an image forming apparatus provided with the pre-exposure means, and for example, an effect such that the end portion contamination can be suppressed while facilitating suppression of the image flow through the decrease in discharge amount to the photosensitive member during the charging by decreasing the exposure amount of the pre-exposure means.

According to the present invention, it is possible to suppress the end portion contamination while suppressing the image flow.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-152692 filed on Sep. 17, 2021, which is hereby incorporated by reference herein in its entirety.

What is claimed is:

1. An image forming apparatus for forming an image on a recording material, comprising:

a rotatable photosensitive member;

a charging member configured to electrically charge a surface of said photosensitive member;

a charging power source configured to apply a charging voltage to said charging member;

a developing member configured to form a toner image by supplying toner to a surface of said photosensitive member charged by said charging member;

a transfer member forming a transfer portion in contact with the surface of said photosensitive member and configured to transfer the toner image from the surface of said photosensitive member onto the recording material passing through the transfer portion;

a transfer power source configured to apply a transfer voltage to said transfer member;

an acquiring portion configured to acquire information on an electric resistance value of said transfer member; and a controller capable of controlling said charging power source, wherein said controller controls the charging voltage, applied in an image forming operation for forming the toner image on the recording material, depending on the electric resistance value of said transfer member indicated by the information acquired by said acquiring portion, wherein said controller controls the charging voltage so that the charging voltage is a first charging voltage in a case that the electric resistance value of said transfer member indicated by the information acquired by said acquiring portion is a first resistance value, and so that the charging voltage is a second charging voltage having an absolute value not less than an absolute value of the first charging voltage in a case that the electric resistance value is a second resistance value lower than the first resistance value, and wherein in a case that images are continuously formed on recording materials, said controller controls the charging voltage so that a change amount of the charging voltage in a case that the electric resistance value of said transfer member is changed from the second resistance value to a third resistance value lower than the second resistance value is greater than a change amount of the charging voltage in a case that the electric resistance value is changed from the first resistance value to the second resistance value.

2. An image forming apparatus according to claim 1, wherein said acquiring portion acquires the information on the electric resistance value of said transfer member on the basis of at least one of a voltage value of the voltage applied to said transfer member and a current value of a current flowing through said transfer member when the voltage is applied to said transfer member by said transfer power source during absence of the recording material in the transfer portion.

3. An image forming apparatus according to claim 1, further comprising a developing power source configured to apply a developing voltage to said developing member during formation of the toner image, wherein said controller carries out control so that the developing voltage is a first developing voltage in a case that the charging voltage is the first charging voltage and so that the developing voltage is a second developing voltage higher in absolute value that the first developing voltage in a case that the charging voltage is the second charging voltage.

4. An image forming apparatus according to claim 3, wherein said controller carries out control so that the developing voltage is changed with a change in charging voltage so as to make a difference between the charging voltage and the developing voltage substantially constant.

5. An image forming apparatus for forming an image on a recording material, comprising:

a rotatable photosensitive member;

a charging member configured to electrically charge a surface of said photosensitive member;

a developing member configured to form a toner image by supplying toner to a surface of said photosensitive member charged by said charging member;

a developing power source configured to apply a developing voltage to said developing member during formation of the toner image;

a transfer member forming a transfer portion in contact with the surface of said photosensitive member and configured to transfer the toner image from the surface of said photosensitive member onto the recording material passing through the transfer portion;

a transfer power source configured to apply a transfer voltage to said transfer member;

an acquiring portion configured to acquire information on an electric resistance value of said transfer member; and a controller capable of controlling said developing power source, wherein said controller controls the developing voltage, applied in an image forming operation for forming the toner image on the recording material, depending on the electric resistance value of said transfer member indicated by the information acquired by said acquiring portion, wherein said controller controls the developing voltage so that the developing voltage is a first developing voltage in a case that the electric resistance value of said transfer member indicated by the information acquired by said acquiring portion is a first resistance value, and so that the developing voltage is a second developing voltage having an absolute value not greater than an absolute value of the first developing voltage in a case that the electric resistance value is a second resistance value lower than the first resistance value, and wherein in a case that images are continuously formed on recording materials, said controller controls the developing voltage so that a change amount of the developing voltage in a case that the electric resistance value of said transfer member is changed from the second resistance value to a third resistance value lower than the second resistance value is greater than a change amount of the developing voltage in a case that the electric resistance value is changed from the first resistance value to the second resistance value.

6. An image forming apparatus according to claim 5, wherein said acquiring portion acquires the information on the electric resistance value of said transfer member on the basis of at least one of a voltage value of the voltage applied to said transfer member and a current value of a current flowing through said transfer member when the voltage is applied to said transfer member by said transfer power source during absence of the recording material in the transfer portion.

7. An image forming apparatus comprising:

a rotatable photosensitive member;

a charging member configured to electrically charge a surface of said photosensitive member;

a charging power source configured to apply a charging voltage to said charging member;

a developing member configured to form a toner image by supplying toner to a surface of said photosensitive member charged by said charging member;

a transfer member forming a transfer portion in contact with the surface of said photosensitive member and configured to transfer the toner image from the surface of said photosensitive member onto a recording material passing through the transfer portion;

a transfer power source configured to apply a transfer voltage to said transfer member;

a first acquiring portion configured to acquire information on an electric resistance value of said transfer member;

a second acquiring portion configured to acquire information on an electric resistance value of the recording material; and a controller capable of controlling said charging power source, wherein said controller carries out control so that the charging voltage applied in an image forming operation for forming the toner image on the recording material is a first charging voltage in a case that the electric resistance value of said transfer member indicated by the information acquired by said first acquiring portion is a first resistance value, and so that the charging voltage applied in the image forming operation is a second charging voltage greater in absolute value than the first charging voltage in a case that the electric resistance value of said transfer member indicated by the information acquired by said first acquiring portion is a second resistance value lower than the first resistance value, and wherein said controller carries out control so that the charging voltage is the second charging voltage in a case that the electric resistance value of said transfer member indicated by the information acquired by said first acquiring portion is the second resistance value and in a case that the electric resistance value of the recording material indicated by the information acquired by said second acquiring portion is a third resistance value, and so that the charging voltage is a third charging voltage less in absolute value than the second charging voltage in a case that the electric resistance value of the recording material indicated by the information acquired by said second acquiring portion is a fourth resistance value lower than the third resistance value.

8. An image forming apparatus according to claim 7, wherein said second acquiring portion acquires the information on the electric resistance value of the recording material on the basis of at least one of a voltage value of the voltage applied to said transfer member and a current value of a current flowing through said transfer member when the voltage is applied to said transfer member by said transfer power source during absence of the recording material in the transfer portion and on the basis of at least one of a voltage value of the voltage applied to said transfer member and a current value of the current flowing through said transfer member when the voltage is applied to said transfer member by said transfer power source during presence of the recording material in the transfer portion.

9. An image forming apparatus according to claim 7, wherein said second acquiring portion acquires the information on the electric resistance value of the recording material on the basis of information on a kind of the recording material.

10. An image forming apparatus according to claim 9, wherein the information on the kind of the recording material includes information on a thickness of the recording material.

11. An image forming apparatus according to claim 7, wherein said second acquiring portion acquires the information on the electric resistance value of the recording material on the basis of information on whether or not, in double-side image formation, image formation is first-side image formation or second-side image formation.

12. An image forming apparatus comprising:

a rotatable photosensitive member;

a charging member configured to electrically charge a surface of said photosensitive member;

a developing member configured to form a toner image by supplying toner to a surface of said photosensitive member charged by said charging member;

a developing power source configured to apply a developing voltage to said developing member during formation of the toner image;

a transfer member forming a transfer portion in contact with the surface of said photosensitive member and configured to transfer the toner image from the surface of said photosensitive member onto a recording material passing through the transfer portion;

a transfer power source configured to apply a transfer voltage to said transfer member;

a first acquiring portion configured to acquire information on an electric resistance value of said transfer member;

a second acquiring portion configured to acquire information on an electric resistance value of the recording material; and a controller capable of controlling said developing power source, wherein said controller carries out control so that the developing voltage applied in an image forming operation for forming the toner image on the recording material is a first developing voltage in a case that the electric resistance value of said transfer member indicated by the information acquired by said first acquiring portion is a first resistance value, and so that the developing voltage applied in the image forming operation is a second developing voltage, less in absolute value than the first developing voltage in a case that the electric resistance value of said transfer member indicated by the information acquired by said first acquiring portion is a second resistance value lower than the first resistance value, and wherein said controller carries out control so that the developing voltage is the second developing voltage in a case that the electric resistance value of said transfer member indicated by the information acquired by said first acquiring portion is the second resistance value and in a case that the electric resistance value of the recording material indicated by the information acquired by said second acquiring portion is a third resistance value, and so that the developing voltage is a third developing voltage greater in absolute value than the second developing voltage in a case that the electric resistance value of the recording material indicated by the information acquired by said second acquiring portion is a fourth resistance value lower than the third resistance value.

13. An image forming apparatus according to claim 12, wherein said second acquiring portion acquires the information on the electric resistance value of the recording material on the basis of at least one of a voltage value of the voltage applied to said transfer member and a current value of a current flowing through said transfer member when the voltage is applied to said transfer member by said transfer power source during absence of the recording material in the transfer portion and on the basis of at least one of a voltage value of the voltage applied to said transfer member and a current value of the current flowing through said transfer member when the voltage is applied to said transfer member by said transfer power source during presence of the recording material in the transfer portion.

14. An image forming apparatus according to claim 12, wherein said second acquiring portion acquires the information on the electric resistance value of the recording material on the basis of information on a kind of the recording material.

15. An image forming apparatus according to claim 14, wherein the information on the kind of the recording material includes information on a thickness of the recording material.

16. An image forming apparatus according to claim 12, wherein said second acquiring portion acquires the information on the electric resistance value of the recording material on the basis of information on whether or not, in double-side image formation, image formation is first-side image formation or second-side image formation.

* * * * *